US007185890B2

(12) United States Patent
Trivedi

(10) Patent No.: US 7,185,890 B2
(45) Date of Patent: Mar. 6, 2007

(54) METHOD AND APPARATUS FOR PLAYING A STOCK TRADING SIMULATION GAME

(75) Inventor: Hariprasad S. Trivedi, Columbia, MO (US)

(73) Assignee: A.A.M., LLC, Brookfield, WI (US)

( * ) Notice: Subject to any disclaimer, the term of this patent is extended or adjusted under 35 U.S.C. 154(b) by 0 days.

(21) Appl. No.: 10/833,812

(22) Filed: Apr. 28, 2004

(65) Prior Publication Data

US 2005/0242502 A1 Nov. 3, 2005

(51) Int. Cl.
*A63F 3/00* (2006.01)

(52) U.S. Cl. ..... 273/278; 273/256

(58) Field of Classification Search ..... 273/278, 273/256

See application file for complete search history.

(56) References Cited

U.S. PATENT DOCUMENTS

| | | | | |
|---|---|---|---|---|
| 2,182,531 | A | 12/1939 | Beard | |
| 3,740,037 | A | 6/1973 | De Bono | |
| 3,865,380 | A | 2/1975 | Thomas | |
| 3,980,307 | A | 9/1976 | Raub | |
| RE29,355 | E | 8/1977 | Lefevre et al. | |
| 4,312,510 | A | 1/1982 | Bodner | |
| 4,431,195 | A | 2/1984 | Brand et al. | |
| 4,452,457 | A | 6/1984 | Atieh et al. | |
| 4,535,994 | A | 8/1985 | Cowan | |
| 4,871,177 | A * | 10/1989 | Mock | 273/256 |
| 4,934,707 | A | 6/1990 | Koster | |
| 5,829,747 | A | 11/1998 | Nebel | |
| 5,934,674 | A | 8/1999 | Bukowsky | |
| 6,032,957 | A * | 3/2000 | Kiyosaki et al. | 273/256 |
| 6,189,886 | B1 | 2/2001 | Moran | |
| 6,322,076 | B1 | 11/2001 | Fikki | |
| 6,390,472 | B1 | 5/2002 | Vinarsky | |
| 6,446,970 | B1 | 9/2002 | Kyrollos | |

* cited by examiner

*Primary Examiner*—Vishu Mendiratta
(74) *Attorney, Agent, or Firm*—Jeffrey A. Proehl

(57) ABSTRACT

A method of playing a stock trading simulation game is disclosed and includes providing a game apparatus including a game board having a plurality of spaces marked thereon defining a path of movement on the game board, with a portion of the plurality of spaces representing individual stock positions. The method further includes a plurality of methods for ending play of the game, establishing an Exchange for handling exchange of game money and stock positions during play of the game, and taking a turn by one of the players, with the turn comprising taking a hidden turn and taking an open turn. A game apparatus may include the game board, a trade transaction sheet for recording trades of stock positions, a hidden bid card for secretly recording hidden bids, and a number of game pieces including open turn and hidden turn game pieces.

55 Claims, 15 Drawing Sheets

42

1
END OF
QUARTER I

42

A major player in one the sectors you prominently own raises earnings and revenue forecast (projects earnings per share a penny above consensus estimates) for the coming quarter. The sector stocks are up and the value of your portfolio is up by 5% overnight. Collect $1000.

FIG. 5

44

1
END OF
QUARTER II

44

A major player in one the sectors you prominently own raises earnings and revenue forecast (projects earnings per share 2 pennies above consensus estimates) for the coming quarter. The sector stocks are up and the value of your portfolio is up by 5% overnight. Collect $1500.

FIG. 6

46

1
END OF
QUARTER III

46

A major player in one the sectors you prominently own raises earnings and revenue forecast (projects earnings per share 3 pennies above consensus estimates) for the coming quarter. The sector stocks are up and the value of your portfolio is up by 5% overnight. Collect $ 2000.

FIG. 7

METHOD AND APPARATUS FOR PLAYING A STOCK TRADING SIMULATION GAME

RELATED DATA

The subject matter of the present utility patent application has been registered with the United States Patent and Trademark Office under the disclosure document program. Two separate requests for registration under the disclosure document program have been filed. The first request was received at the United States Patent and Trademark on Sep. 20, 2002 and was assigned the registration number 519245. The second request was received at the United States Patent and Trademark Office on Nov. 13, 2002 and was assigned the registration number 521378.

BACKGROUND OF THE INVENTION

1. Field of the Invention

The present invention relates to stock trading simulation games and more particularly pertains to a new method and apparatus for playing a stock trading simulation game to simulate the benefits and pitfalls of bidding on and trading stocks and commodities, and speculation in financial instruments and instruments of investment.

2. Description of the Prior Art

The use of stock trading simulation games is known in the prior art. However, the manner of simulating bidding for stocks in the known games is believed to be rather limited in the realism that may be achieved.

The method and apparatus for playing a stock trading simulation game according to the present invention substantially departs from the conventional concepts and designs of the prior art, and in so doing provides an apparatus primarily developed for the purpose of simulating the benefits and pitfalls of bidding on and trading stocks and commodities, and speculation in financial instruments and instruments of investment.

SUMMARY OF THE INVENTION

In view of the foregoing disadvantages inherent in the known types of stock trading simulation games now present in the prior art, the present invention provides a new method and apparatus for playing a stock trading simulation game to simulate the benefits and pitfalls of bidding on and trading stocks and commodities and speculation in financial instruments and instruments of investment.

To attain this, one aspect of the invention includes a method of playing a stock trading simulation game that includes providing a game apparatus including a game board having a plurality of spaces marked thereon defining a path of movement on the game board, with a portion of the plurality of spaces representing individual stock positions. The method further includes a plurality of methods for ending play of the game, establishing an Exchange for handling exchange of game money and stock positions during play of the game, and taking a turn by one of the players, with the turn comprising taking a hidden turn and taking an open turn.

Another aspect of the invention contemplates a game apparatus may include the game board, a trade transaction sheet for recording trades of stock positions, a hidden bid card for secretly recording hidden bids, and a number of game pieces including open turn and hidden turn game pieces.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Advantages of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects of the invention will become apparent when consideration is given to the following detailed description thereof. Such description makes reference to the annexed drawings wherein:

FIG. 5 is a schematic front and rear view of an "END OF QUARTER I" card of the present invention.

FIG. 6 is a schematic front and rear view of an "END OF QUARTER II" card of the present invention.

FIG. 7 is a schematic front and rear view of an "END OF QUARTER III" card of the present invention.

DESCRIPTION OF PREFERRED EMBODIMENTS

Figure 1:
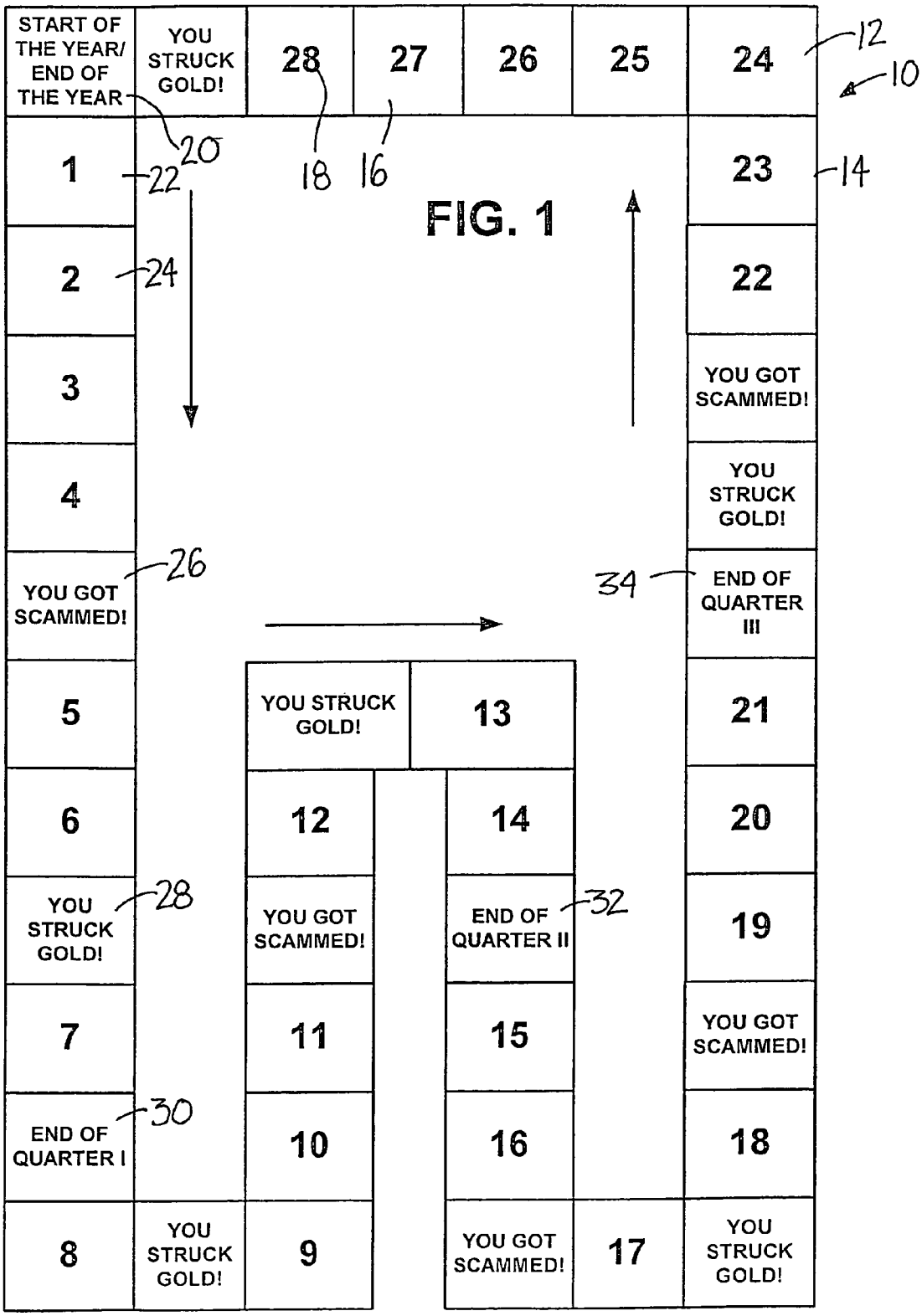
FIG. 1 is a schematic top view of a game board for the new method and apparatus for playing a stock trading simulation game according to the present invention.
Figure 2:
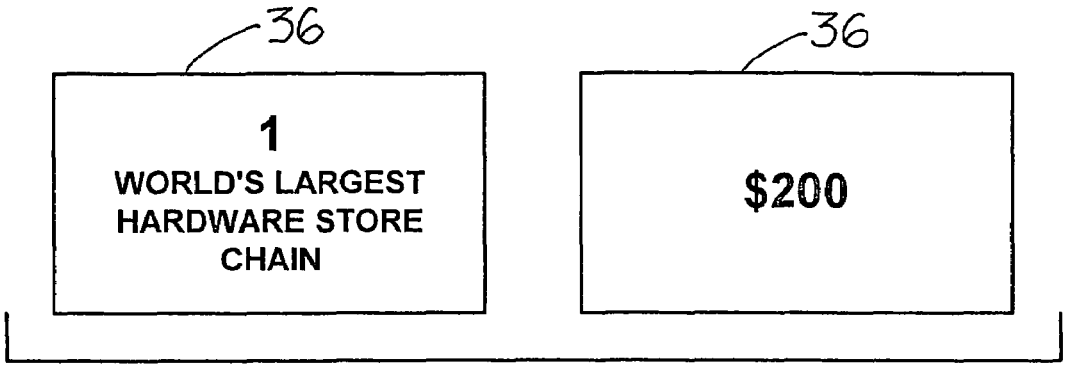
FIG. 2 is a schematic front and rear view of a stock position card of the present invention.
Figure 3:
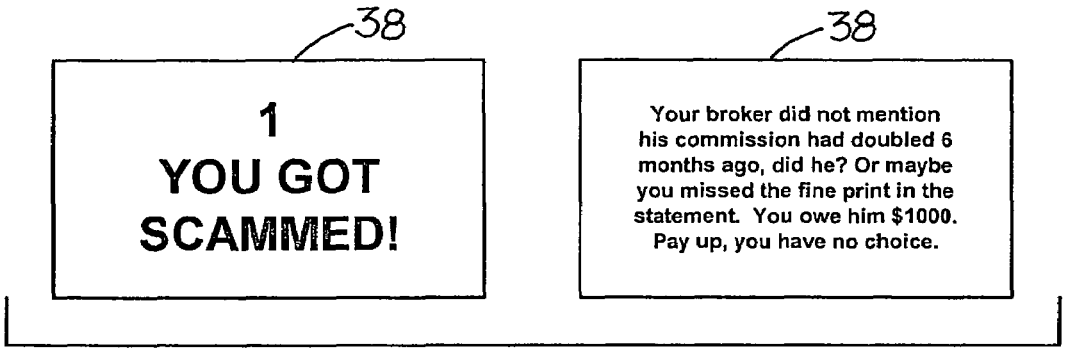
FIG. 3 is a schematic front and rear view of a "YOU GOT SCAMMED!" card of the present invention.
Figure 4:
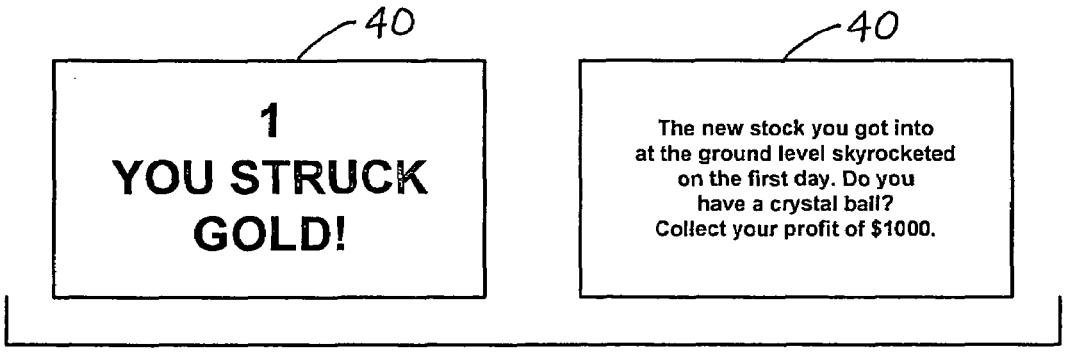
FIG. 4 is a schematic front and rear view of a "YOU STRUCK GOLD!" card of the present invention.
Figure 8:
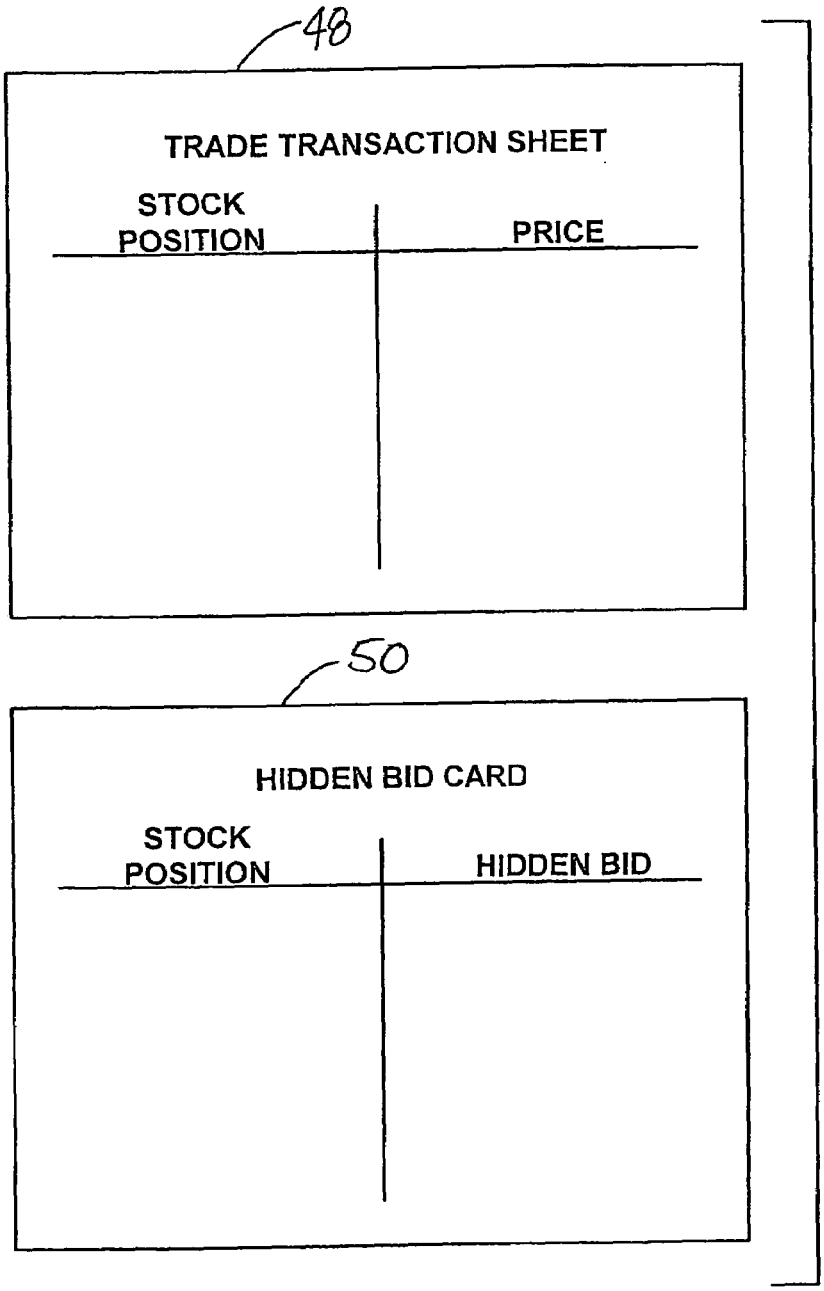
FIG. 8 is a schematic front view of a trade transaction sheet and a hidden bid card of the present invention.

With reference now to the drawings, and in particular to FIGS. 1 through 17 thereof, a new method and apparatus for playing a stock trading simulation game embodying the principles and concepts of the present invention will be described.

Equipment

A game board 10 (see FIG. 1) is provided with a plurality of spaces 12 that are marked on the top surface of the game board and that define a game path 14. A plurality of the spaces on the game board may represent stocks as stock positions 16 (hereinafter referred to as "positions"), and each may be demarcated by numbers 18 and legends identifying fictitious companies. Illustratively, the initial space 20 may be marked as "START OF THE YEAR/END OF THE YEAR". The first stock position 22 space may be marked with the numeral "1", and the second stock position 24 may be marked with the numeral "2", and so on. Various spaces interspersed among the numbered positions may include the legends "YOU GOT SCAMMED!" (space 26), "YOU STRUCK GOLD!" (space 28), "END OF QUARTER I" (space 30), "END OF QUARTER II" (space 32), and "END OF QUARTER III" (space 34) that have a significance that will soon become apparent.

Game cards 36 (see FIG. 2) may be provided for each stock position on the game board as an indicator of ownership of the position. Also, game cards (see FIGS. 3 through 7) may be provided for each of the other spaces on the game board that are marked with the various legends described above, such as "YOU GOT SCAMMED" cards 38, "YOU STRUCK GOLD!" cards 40, "END OF QUARTER I" cards 42, "END OF QUARTER II" cards 44, and "END OF QUARTER III" cards 46.

A trade transaction sheet 48 (see FIG. 8) may also be maintained to record the various trades and the amount of game money associated with the trade. Additionally, each player may be provided with a hidden bid card 50 (see FIG. 8)for recording hidden bids in a secret manner during the course of the game.

Prior to the start of the game, each player is given an amount of game money and a number of game pieces. In one implementation of the game, each player may be given an amount of $12,000 in game money. This amount may be distributed to each player in the form of five $1,000 bills, eight $500 bills, and thirty $100 bills.

Game pieces may be distributed to each player, and may include an open turn game piece and a hidden turn game piece. The colors of the open turn and hidden turn game pieces of each player should match and the matching color of each player's game pieces should be different from the colors of the game pieces of the other players to facilitate identification of the game pieces with the individual players.

Start of Game

Two to six players may play the game of the invention at a time, although it is possible that more person may participate.

At the beginning of game play, an entity known as the Exchange owns all the excess game money (not distributed to players as described above) and stock positions and therefore all position game cards may be held by the Exchange at the beginning of the game.

Figure 9:
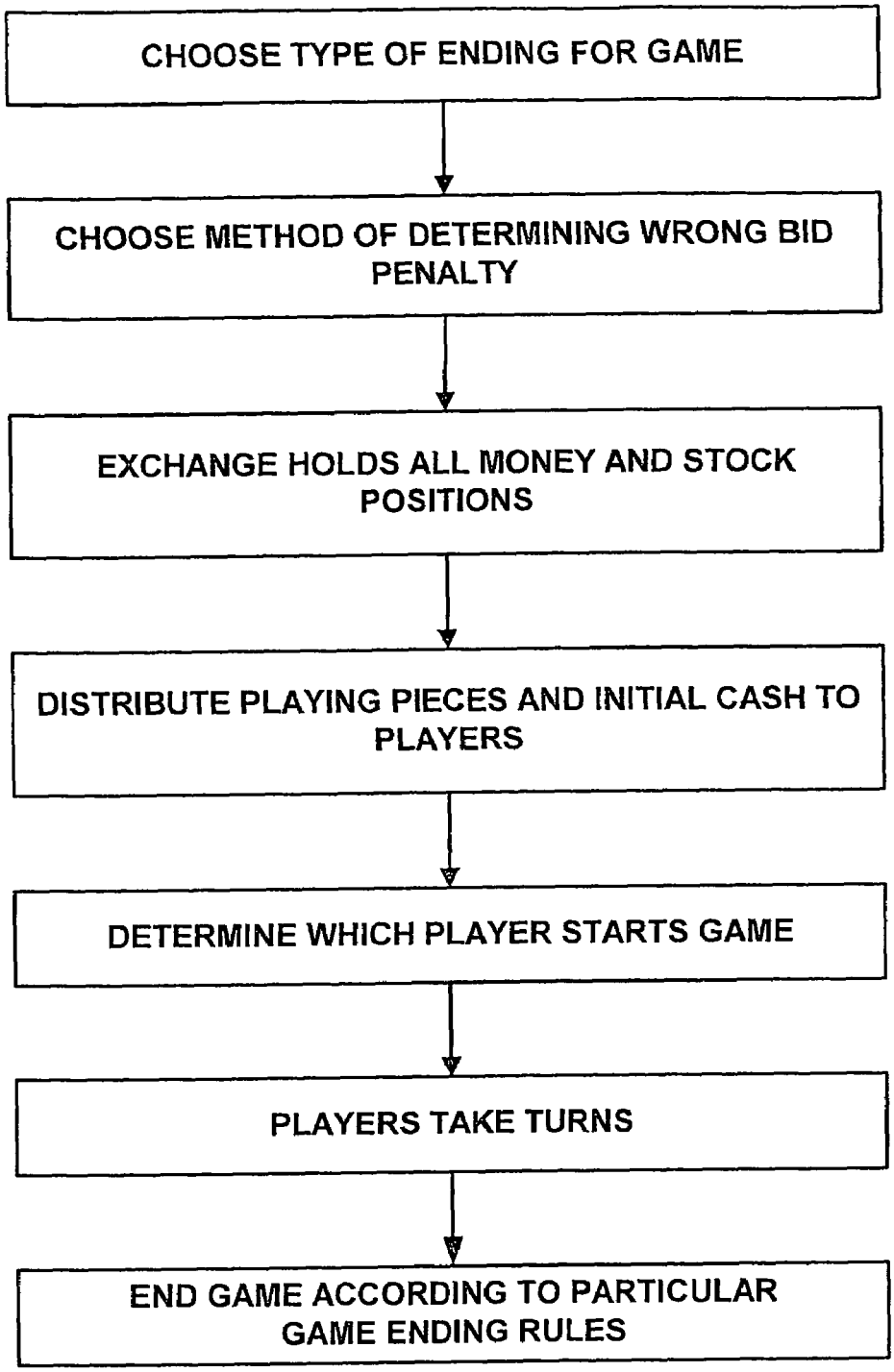
FIG. 9 is a schematic flow diagram of a general process of the game of the present invention.
Figure 10:
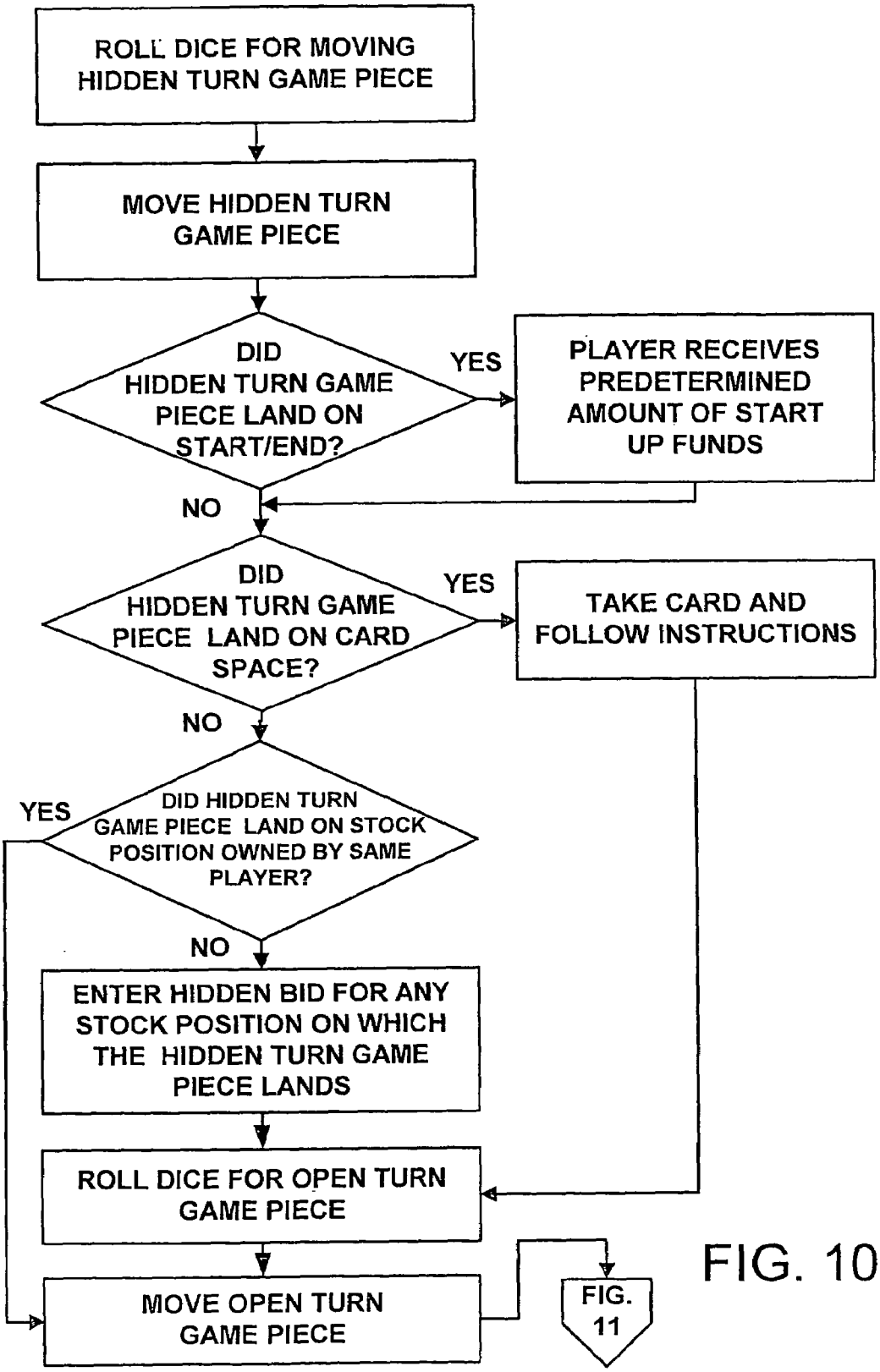
FIG. 10 is a schematic flow diagram of the hidden turn process and a portion of the open turn process of the present invention.
Figure 11:
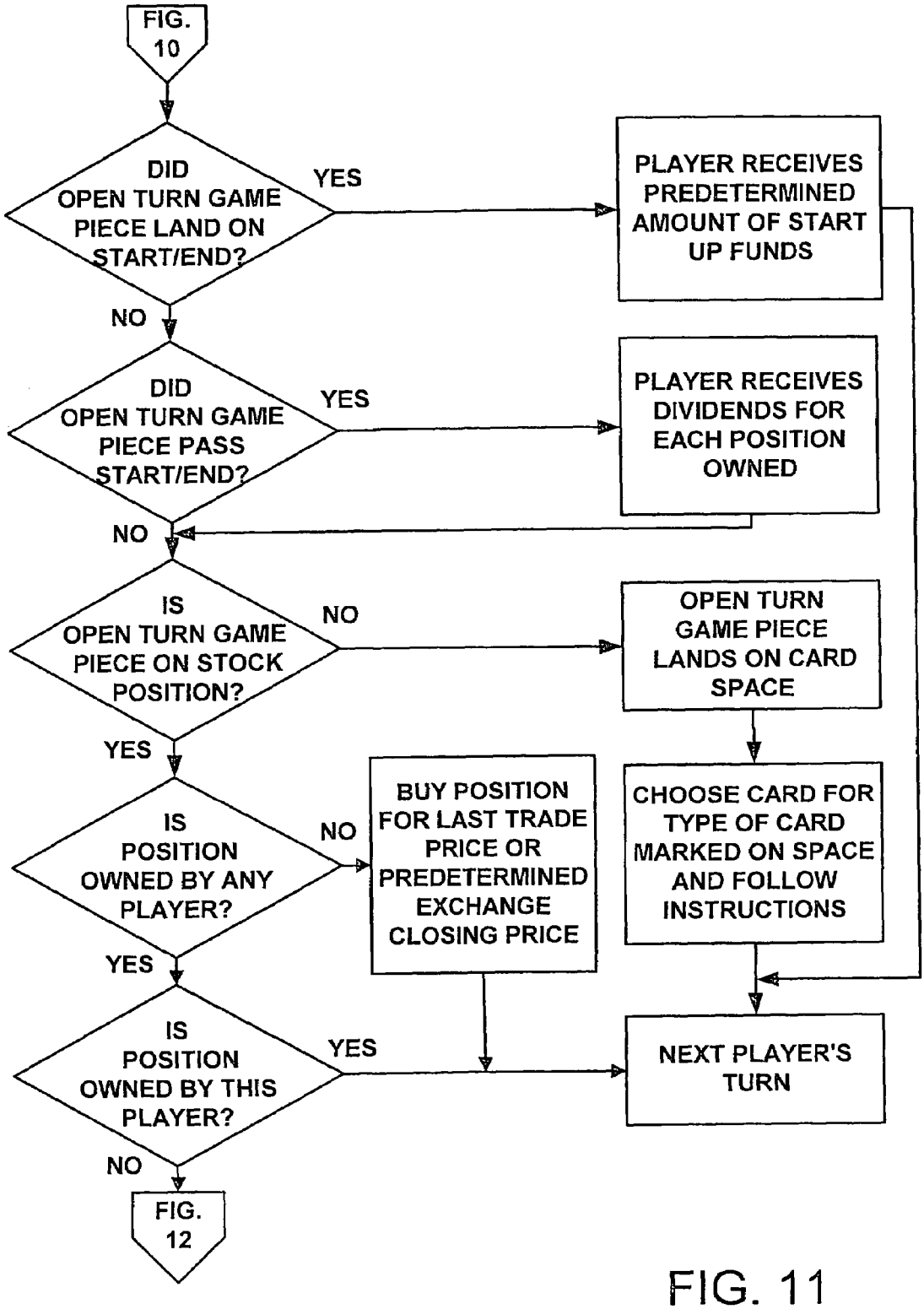
FIG. 11 is a schematic flow diagram of another portion of the open turn process of the present invention.
Figure 12:
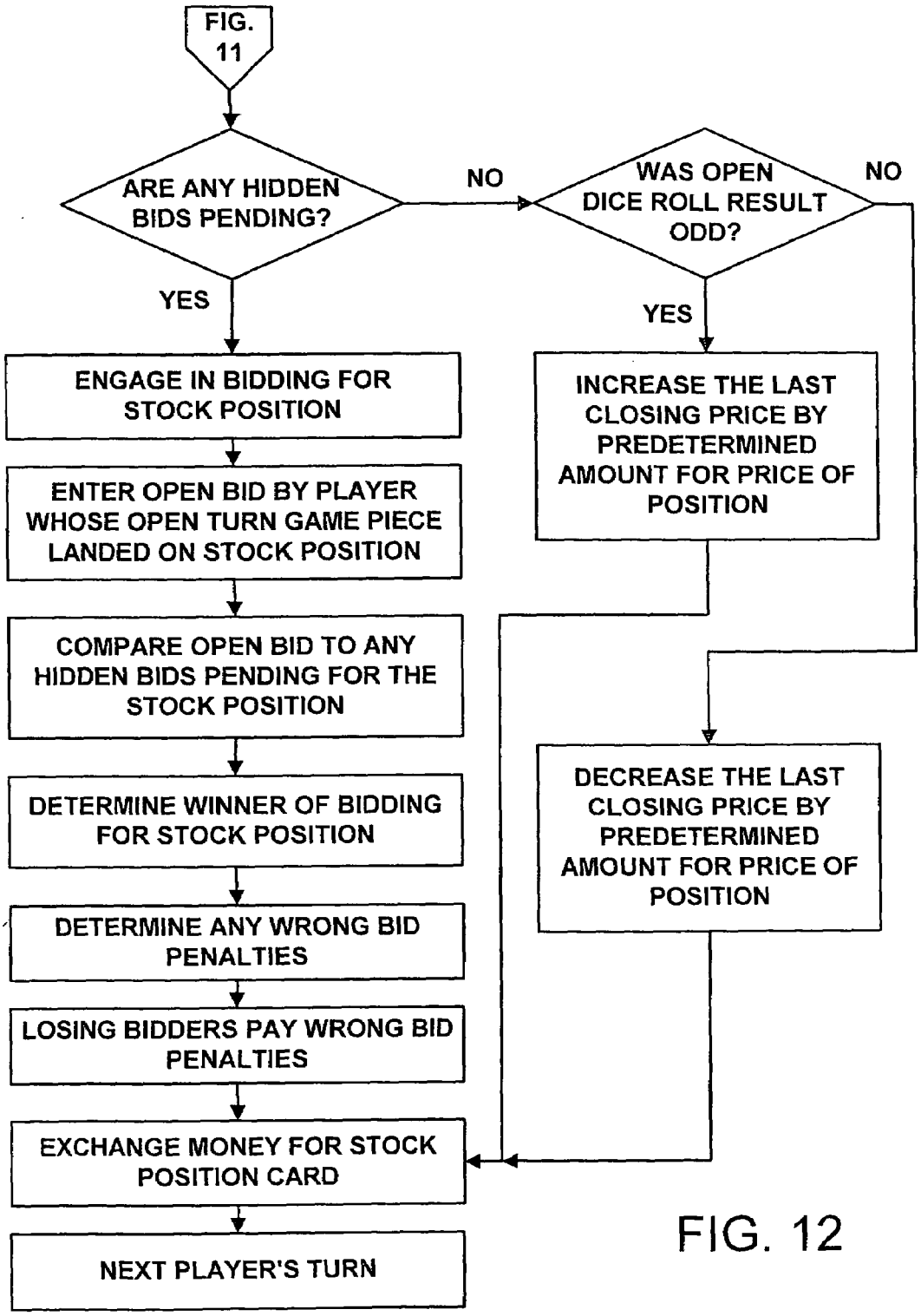
FIG. 12 is a schematic flow diagram of another portion of the open turn process of the present invention including the bidding process for a stock position.

Initially, before the game is begun, the players may choose a specific type of manner or way in which the game is to end or terminate (see FIG. 9). The various game ending options are described in greater detail below.

The game may start by each player rolling the dice once to determine the order of the turns. Illustratively, the player with highest roll of dice (total of both dice) gets the first turn, followed by the second highest, and so on. In case of a tie between the rolls of two or more players, the dice roll should be repeated by those players to break the tie and decide which of the tying players will go before the other tying player or players. The player who has the first turn may be designated at the beginning of the game to handle the activities of the Exchange in addition to his or her activities as a player.

Players begin movement of the game pieces on the game board from the "START OF THE YEAR/END OF THE YEAR" position (see FIG. 1). Illustratively, players may move the game pieces in a counter-clockwise direction on the game board in increments determined by the roll of the dice.

Turns

At each turn, the player rolls the dice twice, with a first roll determining the movement of the hidden game piece (hereinafter referred to as the "hidden turn") and a second roll determining for the movement of the open game piece (hereinafter referred to as the "open turn").

In the case of the hidden turn of the player (see FIG. 10), if the hidden game piece lands on a position of the game board, the player has to make a hidden bid for the position and write it down on the hidden bid card of the player. The hidden bid is kept secret from the other players. Any amount can be bid, but may be limited to the range of amounts from $200 to $1200 in increments of $100. There can be more than one Hidden Bid for a particular position if two or more players land their hidden turn game pieces on it before a player lands his or her open game piece on that position.

In the case of the open turn of the player (see FIG. 11), if the open turn game piece of the player lands on a stock position (or numbered space) on the game board which is not or never has been owned by any player, has never traded, or does not have a hidden bid pending thereupon by any player, it has to be bought by the player from the Exchange for a predetermined Exchange closing price, which may be $1000. This situation is most likely to occur at the start of the game. If the player's open turn game piece lands on a stock position on the game board for which there is no other player's hidden bid, it has to be bought by the player at a price determined by the roll of the dice, which led to the advance of the open turn game piece on that particular stock position. The cost may be determined as follows: If the dice roll for the open turn was an even amount, the cost is $100.00 less than the last trade price. If the dice roll for the open turn was odd, then the price is $100.00 more than the last trade price. The amount paid by the player whose open turn piece landed on the position, $100.00 more or less than the prior last trade price depending on the dice roll, becomes the new last trade price. As an illustrative example, player A's open turn game piece falls on stock position 3 with an even roll of the dice, and there are no hidden bids pending for stock position 3. The stock is owned by player B, as it had been purchased by player B for $900.00. Player A has to pay player B $800.00 and collect the stock position card. For stock position 3, $800.00 now becomes the last trade price. The last trade price may be referred to as the closing price, which is the last price paid by a player for the particular stock position. If there has been no prior trade from which to determine the price, then the closing price is assumed to be a predetermined number, such as, for example, $1000.

When a player's open turn game piece lands on a position for which there is a hidden bid pending, the roll of the dice of the open turn determines the stock opening price. For example, the stock opening price may be equal to the sum of the roll of the dice times $100. Significantly, the stock opening price is also the open bid for the stock position of the player whose open turn game piece has landed on the position. The hidden bid or bids of the player(s) who have pending hidden bids on the position are then revealed and compared to each other and the open bid of the player whose open turn game piece landed on the position and initiated the bidding.

Figure 13:
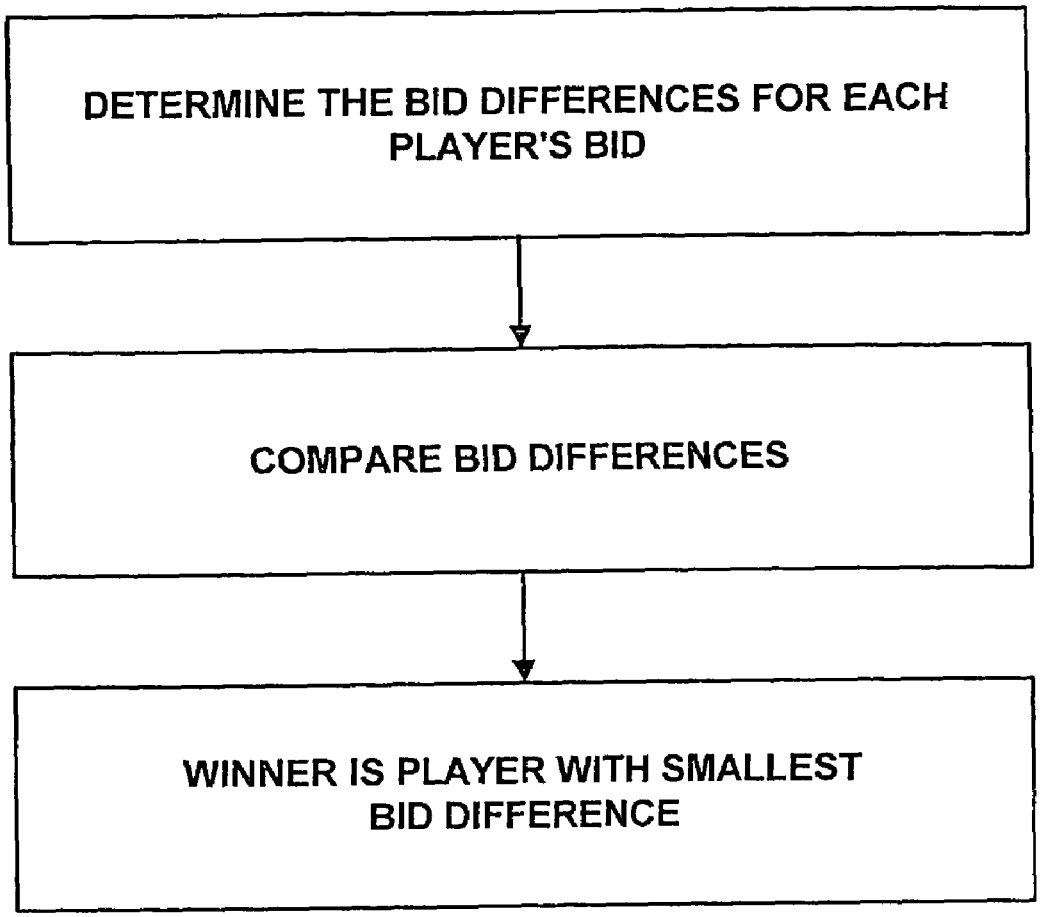
FIG. 13 is a schematic flow diagram of a process for determining a winner of the bidding process for a stock position.
Figure 14:
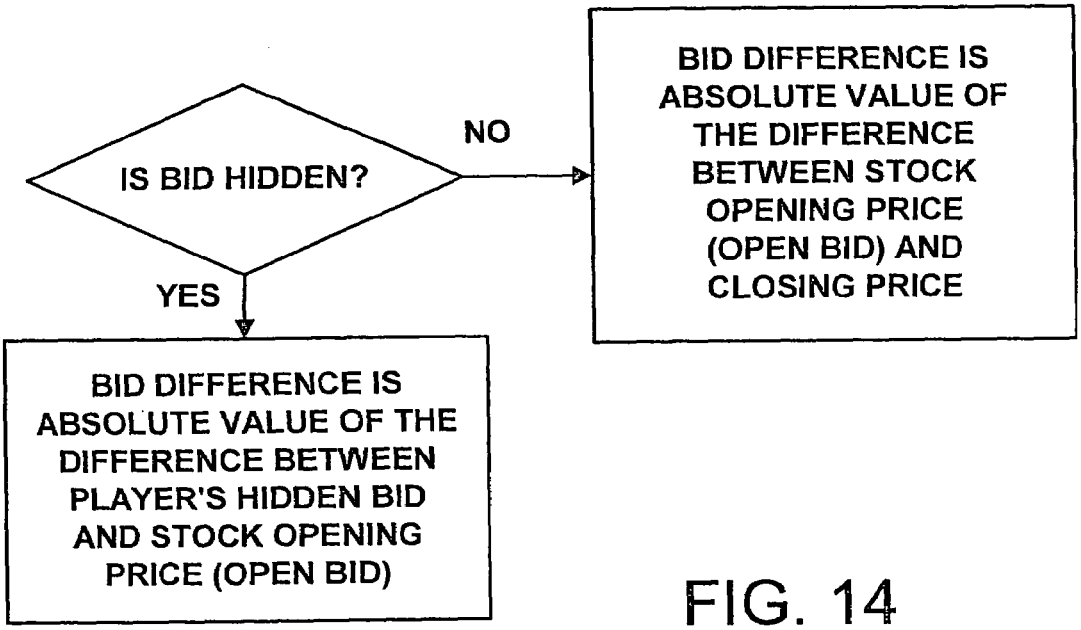
FIG. 14 is a schematic flow diagram of a process for determining the bid difference for open and hidden bids in the bidding process.
Figure 15A:
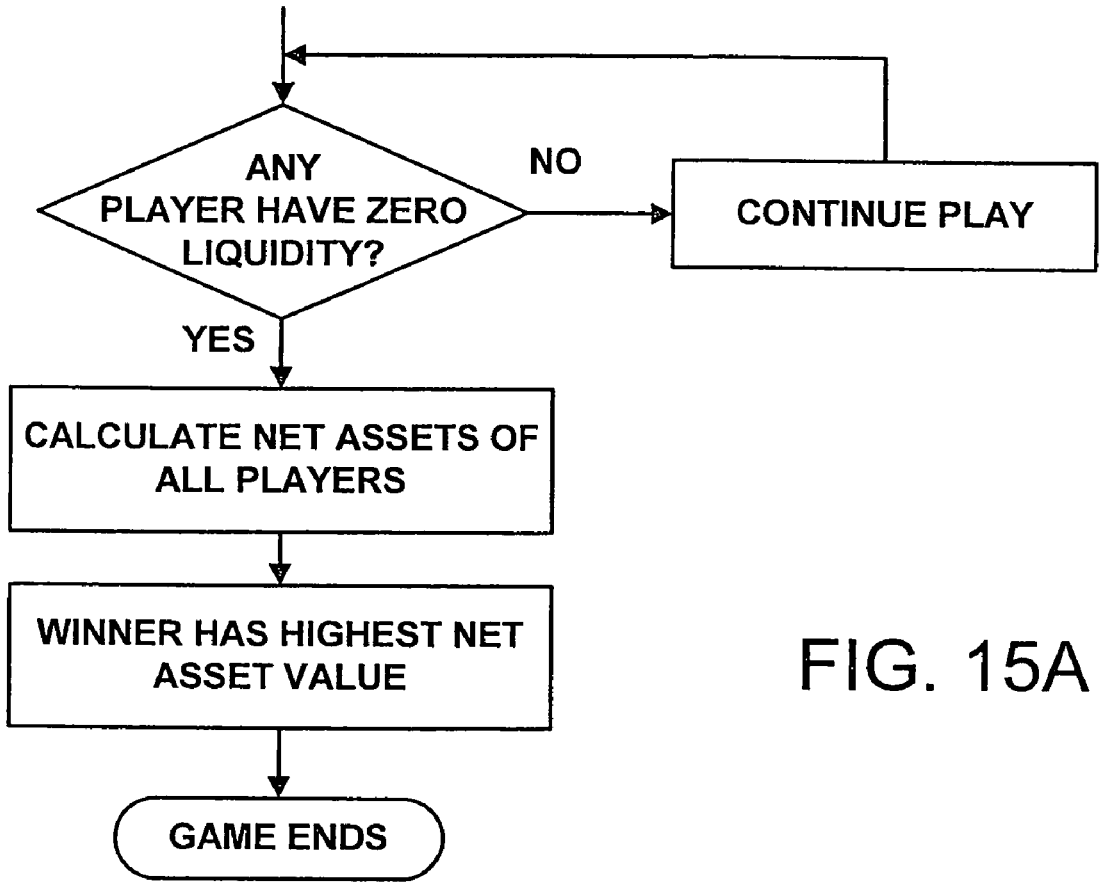
FIG. 15A is a schematic flow diagram of one optional process for ending the game of the present invention based upon the liquidity of the players.
Figure 15B:
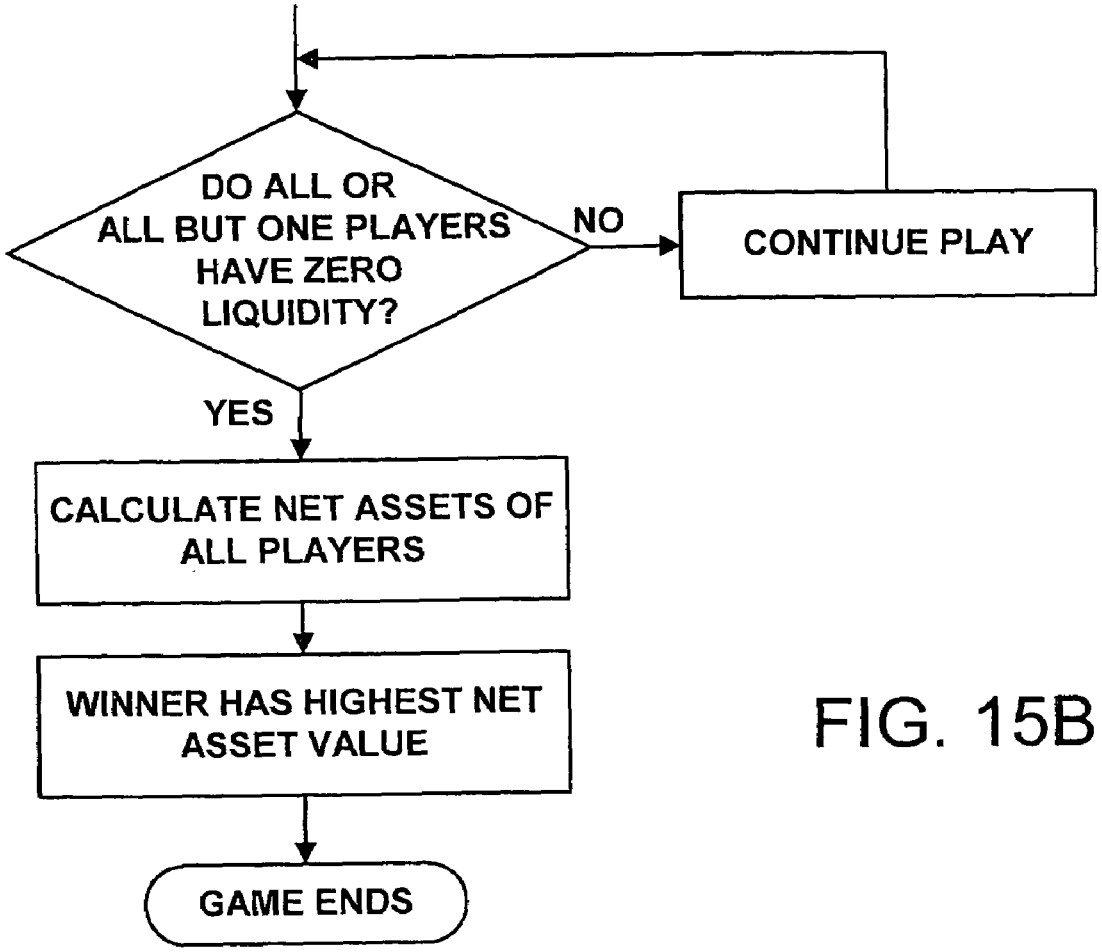
FIG. 15B is a schematic flow diagram of a variation of the optional process for ending the game depicted in FIG. 15A.
Figure 16A:
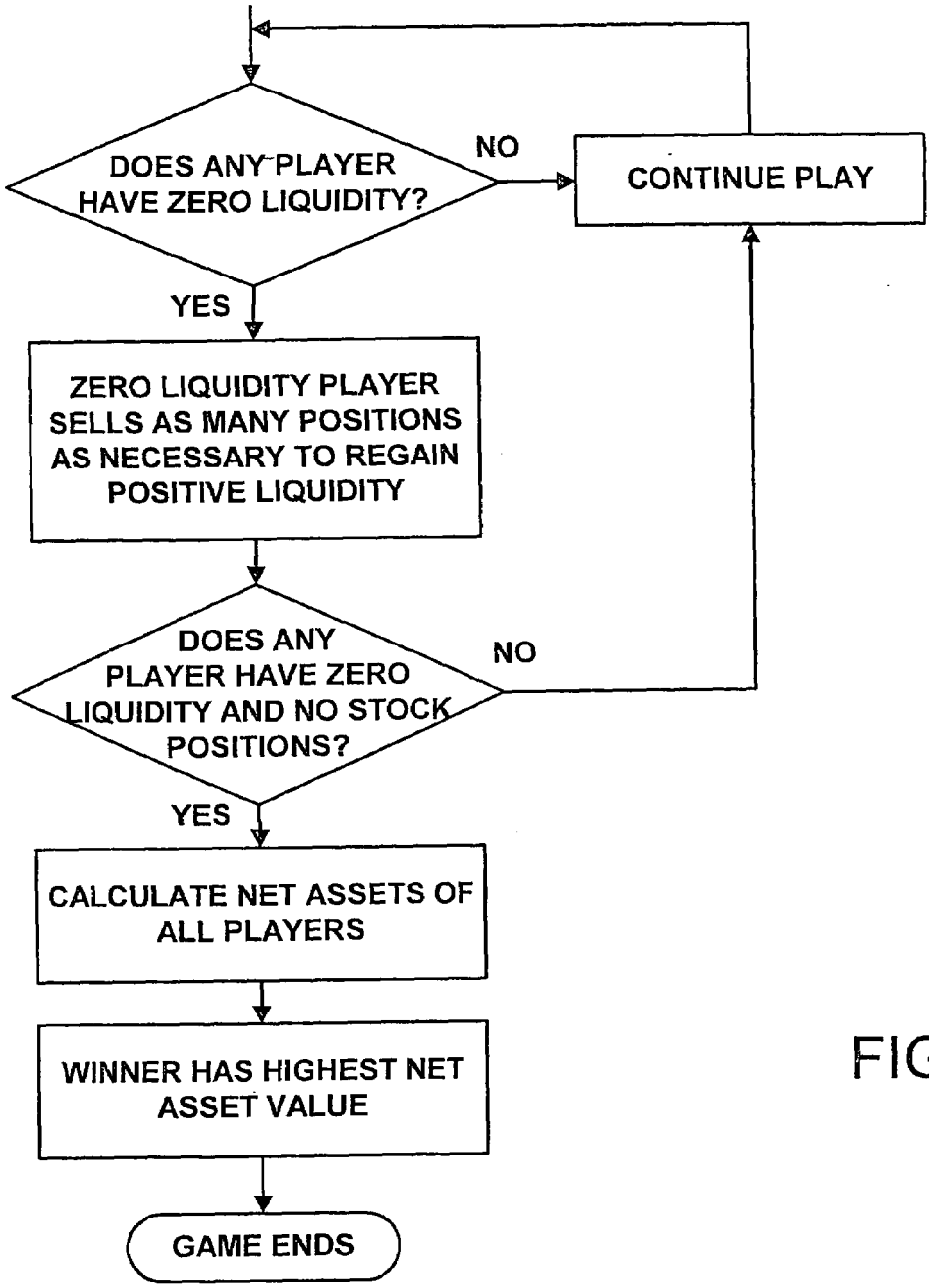
FIG. 16A is a schematic flow diagram of another optional process for ending the game of the present invention based upon the solvency of the players.
Figure 16B:
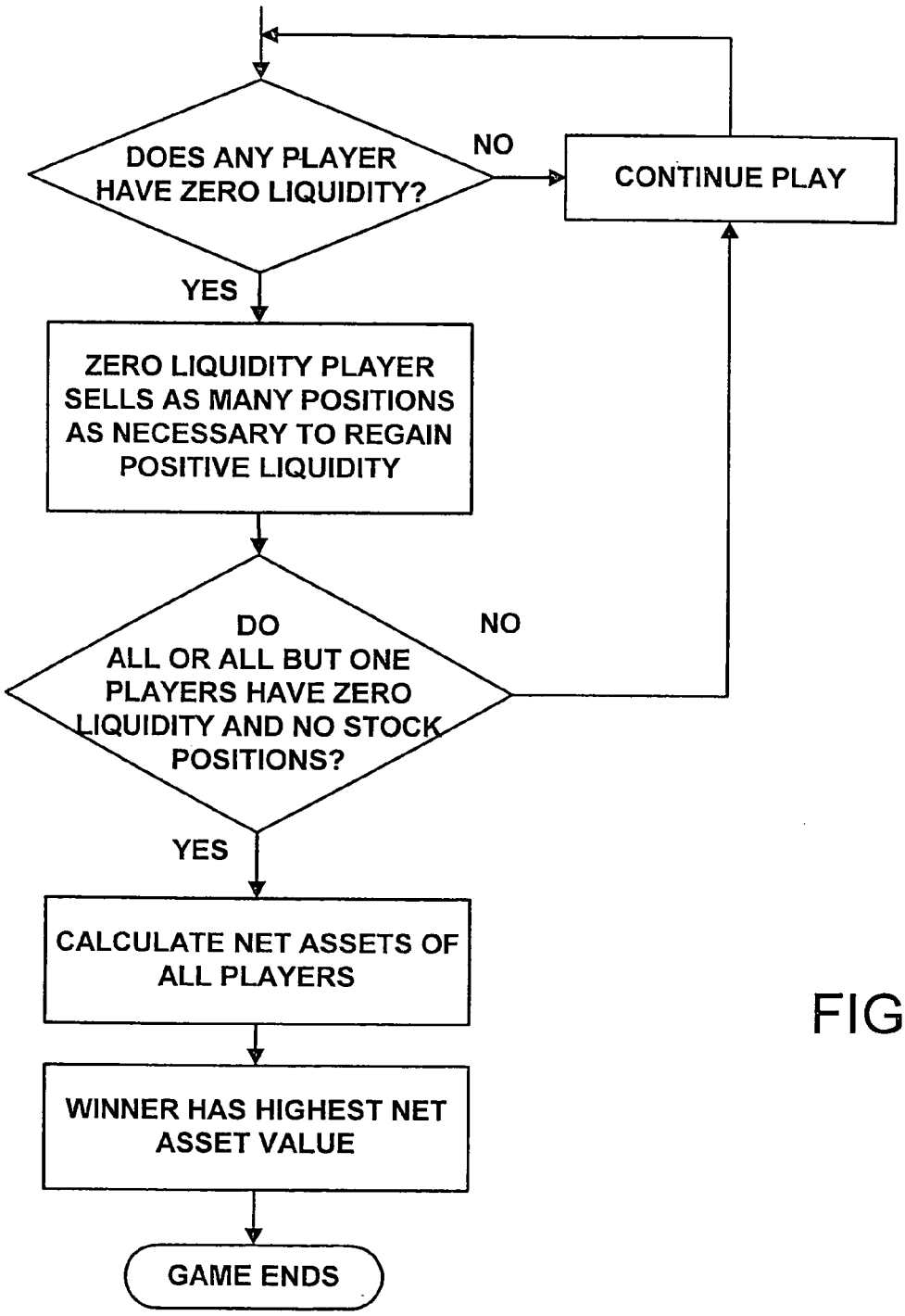
FIG. 16B is a schematic flow diagram of a variation of the optional process for ending the game depicted in FIG. 16B.
Figure 17:
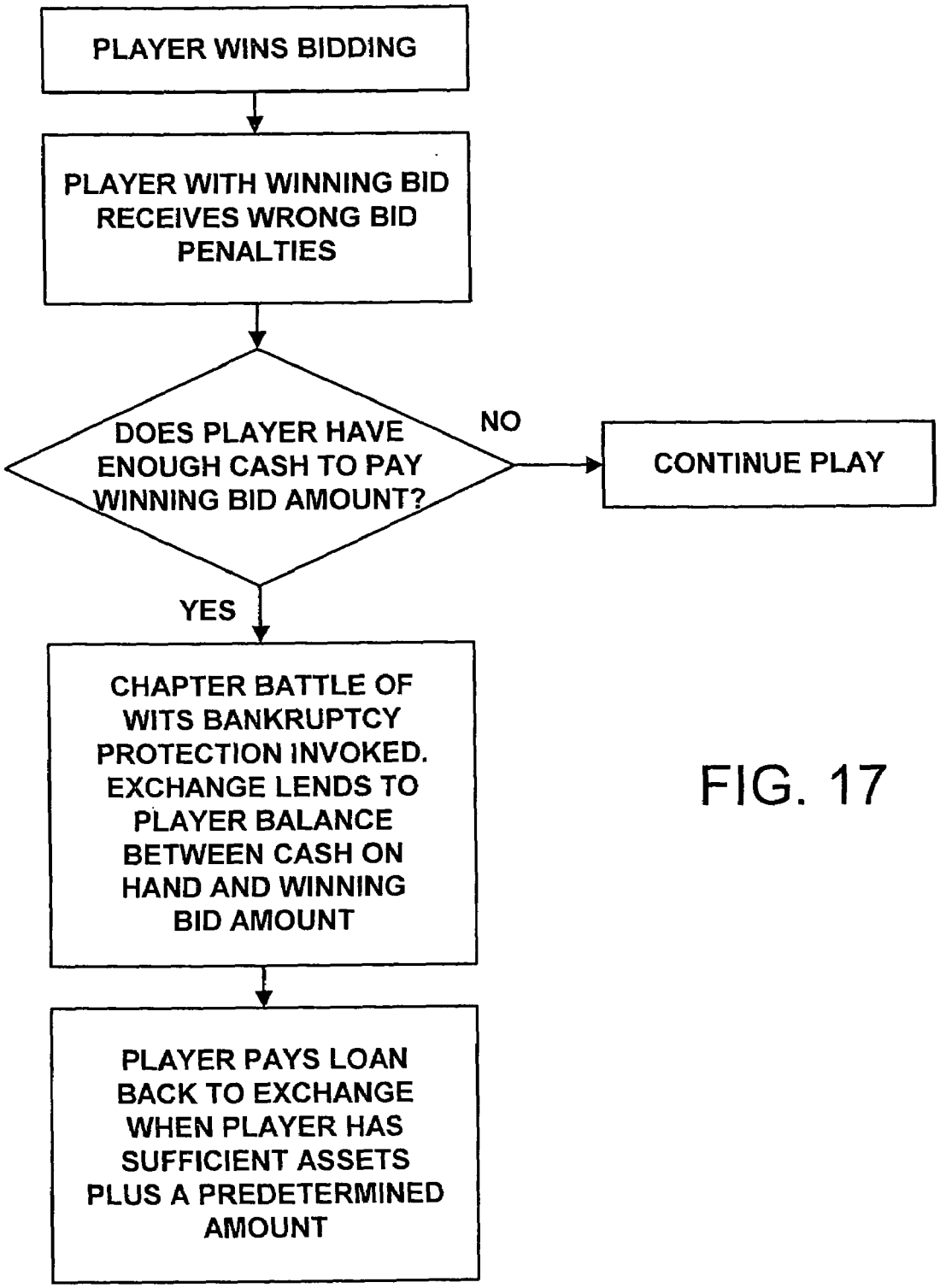
FIG. 17 is a schematic flow diagram of an optional process for providing assistance to players who become bankrupt during playing of the game of the present invention.

The player that wins the bidding for the stock position is the player whose bid has the smallest bid difference (see FIG. 13). The bid difference may be determined differently for the hidden bids as compared to the open bid (see FIG. 14). For example, in the case of the open bid (of the player having the open turn), the bid difference may be the absolute value of the difference between the stock opening price (which is the open bid based upon the roll of the dice) and the last trade price (or the closing price) of the stock. If there has been no prior trade of the stock position, the exchange closing price is the closing price (for example, $1000.00). In the case of the hidden bid or bids, the bid difference may be the absolute value of the difference between the player's hidden bid and the stock opening price (or the open bid).

The winning player pays the amount of the winning bid to the owner of the position. If the position is not owned by a player, then the amount of the winning bid is paid to the Exchange. The winning player collects the position game card either from the player who previously owned the position, or the Exchange, as possession of the position game card determines ownership of the position. The amount of the winning bid becomes the new closing price for the position for the next round of bidding on the stock position.

Occasionally, there may be a tie between players for the smallest bid difference. In that case, the player with highest bid wins. In the rare circumstance where there is a tie for the smallest bid difference and a tie for the highest bid, the tied players who are tied roll the dice to determine the winning player. The tied player with highest roll of dice wins the position, and the losing player or players pay the winning player a penalty of a predetermined amount, such as, for example, $100. If there is a tie for the tie-breaking dice roll, then the dice roll should be repeated until the tie between the players is broken.

Wrong Bid Penalty

The losing bidder or bidders may be required to pay a wrong bid penalty to the winning player of the bidding. The wrong bid penalty may be determined by one of two methods.

A first method of determining the wrong bid penalty for a particular player sets the penalty equal to the absolute value of the difference between the player's bid and the winning bid. As a result, the amount of loss depends on what the other player or players have bid and how far from the winning bid was that the player's bid. Potentially, there may be several losers in each transaction. For example, the owner may lose out if the winning bid is less than the net price paid for the position. Also the losing bidder or bidders may also lose out.

A second method of determining the wrong bid penalty for a particular player sets the penalty equal to the absolute value of the bid difference of the losing player's bid. As with the first method of determining the wrong bid penalty, there may be several potential losers in each trade, including the owner of the position if the winning bid is less than the net price paid for the position, and each losing bidder.

In an illustrative example using the first method of determining the wrong bid penalty, a player A moves his hidden game piece to stock position 1 on the game board. Stock position 1 previously traded for $1200 (e.g., the closing price) and is owned by player E. Player A writes down a hidden bid for $1100. Subsequently, player B's hidden game piece moves to onto stock position 1 and player B writes down a hidden bid for $900. After that, player C's open game piece moves onto stock position 1 on a roll of seven on the dice. In this instance, the stock opening price for stock position 1 is equal to the open bid, which is $700 based upon the roll of the dice.

In this example, player A's bid difference is equal to the player's bid minus the opening price, or $1100 minus $700 equals $400. Player B's bid difference is equal to the player's bid minus the opening price, or $900 minus $700 equals $200. Player C's bid difference is equal to the opening price minus the closing price, or $700 minus $1200 equals $500. (Note: The absolute value of the difference is to be considered so that whether or not a value is negative is irrelevant and therefore a bid difference of −$500 is the same as a bid difference of $500.)

Hence, in this illustrative example, the winner is player B with a bid difference of $200, and the winning bid is $900.00. Player B then pays player E $900 and collects the position card from player E. Player B (who had the winning bid of $900.00) also collects from player A (who had a hidden bid of $1100) a wrong bid penalty of $200.00 ($1100 minus $900 equals $200). Player B also collects from player C (who had an open bid of $700.00) a wrong bid penalty of $200.00 ($900 minus $700 equals $200.00).

Thereafter, for stock position 1, $900.00 becomes the closing price or last trade price. Subsequently, if player D's open game piece moves to stock position 1 as a result of an even dice roll (such as, for example, eight) and there is no hidden bid pending for position 1, player D has to pay $800.00 to player B to get the position. At that point, $800.00 becomes the closing price of position 1. Subsequently, if a player's hidden game piece moves to stock position 1, that player makes a hidden bid. If a player's open turn game piece then lands on position 1, and there is only the one hidden bid pending for that position, the winning bid is determined between the pending hidden bid and the open bid.

In a second illustrative example using the first method, player. A's hidden game piece moves onto stock position 2. The stock position previously traded for $1000, and is presently held by player E. Player A writes down a hidden bid for $900. Subsequently, player B's hidden game piece moves onto stock position 2, and player B makes a hidden bid of $500. Then player C's open game piece moves onto stock position 2 on a roll of the dice of 7. The stock opening price equals the open bid which equals $700. Thus, the bid differences for players A and B are both $200 and for player C is $300. Players A and B are thus tied for the smallest bid difference, but player A has the higher bid amongst the two players and thus wins the position. Player C loses based upon the bid difference. Player A then pays player E the amount of $900 for the position, and collects the position card from player E. Player A collects from player B a wrong bid penalty of $400 and from player C a wrong bid penalty of $200. For stock position 2, $900 becomes the current closing price.

In a third illustrative example using the first method, players A and B both make hidden bid of $1000 for a particular stock position having a last trade price of $800. The open bid of player C for the stock position is $1200. In these circumstances, players A and B have tied for the smallest bid difference and for the highest bid amount. Players A and B roll the dice to break the tie. For example, if player A's dice roll equals 8, and player B's dice roll equals 5, then player A wins. Player A pays the owner of the position $1000, and gets the position. Player A also gets to collect $100 from player B and $200 from player C as the wrong bid penalty. The closing or last trade price for the stock becomes $1000.

In an illustrative example using the second method of calculating the wrong bid penalty, player A's hidden game piece moves onto stock position 1. The stock previously traded for $1100.00 (e.g., the closing price) and is owned by player E. Player A writes down a hidden bid for $1200.00. Then player B's hidden game piece moves onto stock position 1 and player B writes down a hidden bid for $900. After that, player C's open game piece moves to stock position 1 on a roll of dice of 7. In such instance, the stock opening price for the stock position 1 is equal to the open bid, which in this case is $700 (the value of the roll of dice x $100).

In this case, player A's bid difference is equal to player A's bid minus the opening price, or $1200 minus $700 equals $500. Player B's bid difference is also equal to player B's bid minus the opening price, or $900 minus $700 equals $200. Player C's bid difference is equal to the opening price minus the closing price, or $700 minus $1100 equals $400 (note that this is the absolute value of the difference).

Thus, in this illustrative example, the winner is player B with a bid difference of $200 and the winning bid is $900. Player B pays player E the sum of $900 and collects the position card. Player B (with the winning bid) also gets to collect a wrong bid penalty of $500 from player A and a wrong bid penalty of $400 from player C. Now for stock position 1, the closing (or last trade) price becomes $900. If, subsequent to this bidding round, player D's open game piece moves to stock position 1 with an even dice roll of eight 8 (with no hidden bid yet pending), player D has to pay $800 to player B and then receives the position. At this point $800 becomes the closing price. Thereafter, if player F's hidden game piece moves to stock position 1, that player makes a hidden bid, and the process of lodging hidden bids continues until the open bid game piece of a player moves onto the position. If there is only one hidden bid, the winning bid is then chosen between the hidden bid and open bid.

In another illustrative example of the second method, in which a tie between players comes into play, player A's hidden game piece moves onto stock position 2. The stock previously traded for $1000 and is now owned by Player E. Player A writes down a hidden bid for $900. Subsequently, player B's hidden game piece moves onto stock position 2 and player B makes a hidden bid for $500. Then player C's open game piece moves onto stock position 2 with the roll of dice equal to 7. The stock opening price equals the open bid which equals $700 in this example based upon the sum of the dice roll. Thus the bid differences are $200 for both player A and player B, and the bid difference is $300 for player C. Players A and B have tied for the smallest bid difference but player A has the higher bid amongst the two players and therefore wins. Player C loses based on the bid difference. Player A pays player E $900 and collects the position card. Player A also collects a wrong bid penalty from player B of $200 and from player C of $300. For stock position 2, $900 becomes the closing price. If player A and player B both make a hidden bid of $1000 for a stock, with the last trade price of $800 and an open bid from player C of $1200, then players A and B have tied for the least bid difference and for the amount of the bid. Players A and B have to roll the dice to break the tie. If the dice roll of player A equals 8, and the dice roll of player B equals 5, then player A wins the tie breaker. Player A pays the owner of position 2 the amount of $1000, receives ownership of the position, collects $100 from player B, and collects $400 from player C. The closing price for the stock or last trade price becomes $1000. If more than one player ties for the smallest bid difference and the amount of the bids, all respective players have to roll the dice until the tie is broken.

Turns

If a player's open game piece lands on a position for which the same player has a hidden bid pending, the open bid of the player is deemed to be that player's prevailing bid. In such a case, subsequent transactions should occur as if this player's hidden bid were non-existent. In other words, if there are other hidden bids, then the players have to determine the winning bid. If there is no other hidden bid, the player has to buy the position for the adjusted closing price of a prior transaction, such as $100 more or less than the closing price (depending upon the roll of the dice) or a predetermined Exchange closing price.

Every time a player moves his or her open game piece onto a position, all players have to check to see if they have hidden bids for the position. Also, once an open game piece lands on a position for which there are prior pending hidden bids, and the bids are compared and resolved to determine a winning player, money and the position changes hands, thereafter the prior pending hidden bids for that particular position should be crossed out on the players' hidden bid cards. Thus, the position is open for new hidden bids, if and when the hidden game pieces of the players land upon it.

Bidding

Bidding by each player at each opportunity to bid may be made compulsory. Every time a game piece (either an open game piece or a hidden game piece) lands on a position on the game board, the player has to place an appropriate bid—either open or hidden, as the circumstances of the particular game piece require (see FIGS. 10 to 12). There may be two exceptions to the compulsory bidding requirement. In one exception, if a player's game piece (open or hidden) lands on a position owned by the same player, no bidding can occur. In another exception, if a hidden game piece of a player lands on a position for which the player already has a pending hidden bid, no bidding by the player may be required. The latter situation could occur if the player lands on stock position 1, makes a hidden bid, moves his or her hidden bid game piece on and then returns the hidden bid game piece to the same position 1 without an intervening movement of a player's open bid game piece onto position 1. In such an event, the player, upon landing on the position again, has the option to replace the earlier pending hidden bid and make a new hidden bid for the position. However, the player may let the first hidden bid stand as the entry of a new hidden bid is not compulsory. In either of these cases, the player may be required to declare his or her decision on the hidden bid to the other player or players.

Trades

Each time the trade of a position occurs between players, the trade should be recorded on the trade transaction sheet. Each trade may be recorded by designating the name of the position traded and the amount of the transaction (such as the closing price for the position) on the trade transaction sheet. The trade transaction sheet is accessible to all players, and should be referred to as necessary to determine the amount of the last trade.

Cards

When any game piece, either open or hidden, of a player lands on one of the spaces of the game boards that are marked with the legends "You got Scammed!" or "You Struck Gold!", the player landing on the space picks a card from the corresponding group of cards having the same legend. The player then may be required to follow the directions on the card drawn by the player, which may require paying an amount or collecting an amount according to the instructions marked on the card. All payments are made to and collections are taken from the Exchange unless the card instructs otherwise. Further, each card may make reference to an explanation contained on another game piece, such as an information sheet or book, regarding one or more of the financial concepts mentioned on the card.

Dividends

Every time a player's open turn game piece passes or lands on the "START OF THE YEAR/END OF THE YEAR" position on the game board, the Exchange may pay to the player a dividend for each of the positions on the board that player owns at the time of passing the Start/End position. The dividend for each position may be designated on the back of the stock position card corresponding to the particular position. If either the open or the hidden game piece of the player lands directly on the "START OF THE YEAR/END OF THE YEAR" position of the game board, the player is considered to be perfectly positioned to start the new year and receives an additional start-up funds bonus of $500 from the Exchange (over and above any applicable dividends received by the player, which are receivable by the player simultaneously). Every time a piece, hidden or open, lands on the game board spaces marked with the legend "END OF QUARTER I", "END OF QUARTER II", or "END OF QUARTER III", the player may pick a card from the cards marked with the corresponding legend. The player may earn profits or incur losses, depending on the instructions marked on the card picked. Note that a player is only entitled to pick one of these cards if one of the player's game pieces lands directly on one of the marked spaces of the game board. Each fourth of the path of the game board may be thought of as a quarter of the fiscal or business year, and the end of the four quarters is the end of the financial year and start of a new financial year. Each player must keep track of his positions and collect dividends as the open turn piece begins a new financial year. Note that dividends may be collected only when the open turn game piece of the player passes the "START OF THE YEAR/END OF THE YEAR" space, and not when the hidden turn game piece passes this space.

Picking Cards

When a player lands on one of the game board spaces marked "YOU GOT SCAMMED!", "YOU STRUCK GOLD!", or "END OF QUARTER" the player is required to pick a game card from the stack of correspondingly marked game cards. The player may be permitted to choose a card from the respective pile at random, and may not be necessarily required to choose from the top of the pile of appropriate cards. After any card is picked, it is kept aside from the respective stack until all the cards from that particular stack of corresponding cards are picked. Once a card stack has no more cards remaining in the stack, all of the corresponding cards are shuffled and restacked for reuse.

Ending the Game

Optionally, the players may choose between six possible types of game endings that can be selected (see FIGS. 15A, 15B, 16A, 16B, and 17). For beginning players, the second version of the timed ending may be recommended.

One of the ways in which to end the game is the zero liquidity ending, which has two possible versions. In the first version of the zero liquidity ending, the game ends when one of the players develops zero liquidity by running out of money (cash only) or by developing a negative cash balance. At that point, the player with the highest amount of net assets is the winner, with the amount of net assets being equal to the player's cash plus the value of the positions owned by the player, and the value of the positions is equal to the last trade price. It should be noted that the winning player may be the player who developed zero liquidity and caused the game to end. In the second version of the zero liquidity ending, the game ends when all of the players except for one player have developed zero cash liquidity (or have developed a negative balance). In this version, the game would also end if all players simultaneously develop zero cash liquidity (or a negative balance), which could conceivably occur if all players have a marginal cash balance and have bids for a position that result in zero or negative cash balance. The players who develop zero liquidity prior to the end of the game become "sleeping" players. The sleeping players cannot participate in the game after they have developed zero liquidity, and thus are not allowed to roll the dice or otherwise take actions of non-sleeping players. The assets of the sleeping player or players remain the property of the respective players and are included in the calculation of assets at the end of the game. All of the positions owned by a sleeping player become frozen and no bidding can occur for these positions on the game board. When no more than one player remains liquid, the game is ended. The person with the highest amount of assets at that time wins the game. It is conceivable that the winning player could even be a sleeping player with a very high non-cash asset value.

Another way of ending the game is the bankruptcy ending, which also has two versions. In the first version of the bankruptcy ending, the game ends when one of the players becomes bankrupt by running out of money or developing a negative cash balance and by owning no positions to sell. If this manner of ending is selected, as players develop zero cash liquidity or a negative cash balance they may be required to sell off one or more positions that the player owns to the Exchange at the last trade price for the position so that the player is able to pay off any negative balance and the player also has a cash balance of at least a predetermined amount, such as $100. This step may be required to be performed immediately by the player once the player's balance becomes zero or negative. All transactions and game activity (such as the rolling of dice and advancement on the game board) are halted until the player has sold off enough positions to achieve a positive cash balance up to the predetermined minimum cash level. The last trade price of each position sold by the player to the Exchange remains the closing price for any subsequent purchase of the position. The game continues and the bidding goes on as before the liquidation of the positions by the player, except that the owner of the position is now the Exchange. When one player becomes completely bankrupt and has no cash and no positions remaining to sell to the Exchange, the game is ended.

However, if the bankruptcy occurs when the bankrupt player has a winning bid, then the player has to file for Chapter BOW (Battle Of Wits) bankruptcy protection. In such a situation, if the player does not have money to pay the owner of the position, even after receipt of wrong bid penalties by the player, the Exchange may loan the player the balance between the winning bid and the player's cash on hand, and the player continues in the game. It is possible that this player could re-build his or her assets and go on to win the game. The player must reimburse the Exchange an amount equal to the balance owed as soon the player has enough asset value (including cash on hand and positions held) to cover the amount of the loan plus a predetermined amount (such as $100). This reimbursement may involve selling a position to the Exchange. As an illustrative example, player A has only $200 (cash plus amount raised by selling positions owned to the Exchange, if any), but wins a bid for stock position 3 with a bid of $800. Player A receives $400 in wrong bid penalties from other players. However, the player remains short of the winning bid amount by $200. The player enters Chapter BOW, and the Exchange lends the player the $200 to complete the transaction and take ownership of the position. At this point, the player's asset balance is a negative $200. As soon as the player's net asset value becomes $300 (e.g., the $200 amount of the loan plus the $100 amount of the predetermined amount), the player has to pay off the $200 debt owed to the Exchange. Other than this exception, bankruptcy by any player results in the end of the game, and the person with the highest amount of net assets wins the game.

In the second version of the bankruptcy ending, the game is ended when only one player remains solvent, while all of the other players have gone bankrupt. In this version the game would also end if all players become simultaneously bankrupt, which can occur if all players are nearly bankrupt and have bids for a position that result in bankruptcy. The game ending rules for this variation are similar to the first variation of the bankruptcy ending, except that the bankruptcy of a player results in the elimination of that player from the game, and the players are gradually eliminated until no more than one player remains solvent. The rules for invoking Chapter BOW bankruptcy protection apply similarly. At the end of the game, the player with the highest amount of net assets wins the game. On most occasions, the winning player will be the player that has remained solvent. However, if two or more players are nearly bankrupt and have bids for a position that result in bankruptcy, it is possible that the winner may be a bankrupt player with the smallest negative balance.

Another way of ending the game is the timed ending, which also has two versions or variations. In the first variation, prior to the beginning of the game, the players decide a particular game ending time or a time period over which to play. The game is then played using the second version of the zero liquidity rules set forth above. The game ends at the scheduled time, or when no more than one player remains in the game, whichever occurs first. The player with the highest amount of assets is the winning player. In the second variation, the players also decide a particular game ending time prior to the beginning of the game. The game is played using the second version of the bankruptcy ending rules. The game then ends at the scheduled time, or when no more than one player remains solvent, whichever occurs first. Again, the player with the highest amount of assets wins the game.

Some common rules may be observed for all of the endings described above. One common rule that may be observed in all of the various ending methods is that a potential game ending or elimination event (such as having zero cash balance or becoming bankrupt) can occur when a player wins a bid (open or hidden) and cannot cover it, even after collecting any wrong bid penalties. As an example, player A may have $200 cash and may win a bid for stock position 4 with a bid of $800. Player A may receive $400 in wrong bid penalties from other players. Player A is still short by $200 to cover the winning bid. In such a case, player A has to sell one or more positions to the Exchange at the last trade price in order to pay the balance of the winning bid to the owner of the position. For the positions sold, the last trade price remains the closing price, except the owner of the position is now the Exchange. If player A is unable to raise the balance of the winning bid by liquidating the positions owned, player A has to borrow the amount from the Exchange, develop a negative balance, pay the owner and then collect the position card. This transaction has to be completed, as the losing bidders must pay the wrong bid penalties. All game activities may be halted until this transaction is completed.

A second common rule among the various game endings is that at the time of a potential game ending or elimination event, if one or more players owe money to another player, each owing player has to sell one or more positions to the Exchange for the amount of the last trade in order to pay the debt to the other player. In case the player is unable to pay balance owed, such as due to lack of adequate assets, the Exchange may pay the balance of the debt to the creditor player and the indebted player develops a negative balance for the corresponding amount.

A third common rule among the various game endings is that when a player is required to sell a position to the Exchange, the player is not limited to selling any particular position and the player may choose any position that the player owns to sell to the Exchange.

A fourth common rule among the game endings is that when a game piece of a player lands upon a position owned by a sleeping player, no bidding or transaction occurs and no money changes hands.

As mentioned previously, the equipment of the game may include a plurality of stock position cards, with each stock position card corresponding to one of the positions or spaces on the game board. Each of the stock position cards may have the identity of a fictitious business or other institution marked thereon, along with an amount of an annual dividend to be paid to the player holding the stock position card when landing upon or passing the Start/End position in the game board.

As an illustrative example, the stock position cards of the game apparatus may be marked in the following manner, with, for example, a fictitious and imaginary description and/or a fictitious and imaginary proper name of the company behind the stock marked on a front side and the dividend marked on the back side.

1-World's largest hardware store chain (dividend $200)
2-World's largest manufacturer of plumbing systems (dividend $200)
3-A major manufacturer of electronic equipment (dividend $400)
4-A leading manufacturer of software products (dividend $1200)
5-The world's largest fast food chain (dividend $400)
6-The world's largest telecommunications company (dividend $1000)
7-Makes the world's most popular soft drink products (dividend $700)
8-An aircraft manufacturing giant (dividend $500)
9-World's largest manufacturer of farming equipment (dividend $300)
10-World's largest manufacturer of computer processors (dividend $700)
11-The world's leading maker of canned foods (dividend $200)
12-World's largest banking company (dividend $600)
13-World's largest discount store chain (dividend $500).
14-A global gold mining giant (dividend $400)
15-World's largest shipbuilding company (dividend $300)
16-An international pharmaceutical company (dividend $300)
17-The largest paper manufacturer in the world (dividend $300)
18-The world's greatest fashion design-wear manufacturer (dividend $300)
19-A tobacco giant (dividend $300)
20-The world's largest casino chain (dividend $300)
21-The world's largest locomotive manufacturer (dividend $900)
22-A prominent oil and natural gas company (dividend $300)
23-A sporting good manufacturing giant (dividend $300)
24-The largest eatery chain in the world (dividend $800)
25-A global manufacturer of musical instruments (dividend $500)
26-A construction giant (dividend $400)
27-The largest airlines in the world (dividend $600)
28-A leading biotechnology and gene therapy manufacturer (dividend $300)

Further, as noted above, the game apparatus may also include a plurality of game cards corresponding to the "YOU GOT SCAMMED!" positions or spaces on the game board. On one face of the cards may be marked the legend "YOU GOT SCAMMED!" (optionally with a unique number) and on the other face of the cards may be described a fictitious and imaginary scenario and an action to be taken by the player. Further, each of the game cards may include a reference to explanations of financial concepts provided on a separate sheet. The text associated with a number of illustrative examples of the "YOU GOT SCAMMED!" cards follow, each representing a fictitious and imaginary scenario.

1) Your broker did not mention his commission had doubled 6 months ago, did he? Or may be you missed the fine print in the statement. You owe him $1000. Pay up, you have no choice.

2) You were told by your new adviser that copper has no way to go but up, since the economy seems to be rebounding. And therefore, you positioned yourself long copper futures? Is that it? Go figure, copper is down big time. Why? Well, because a large strike in a major copper producer ended. You lost $2000. Pay up now!

3) Did you know you committed a stock trading regulatory violation? The Exchange says you did. It does not matter if you did not place the trade orders yourself. You should not have trusted somebody. You can figure out who later but right now pay the fine of $2000.

4) I told you, you should have researched the contractor who built the house before you bought it. But you did not listen, did you? And now you find out there is a fault in the foundation. Why did the structural inspector not find it? Because there are limitations on such inspections, they cannot detect problems that are not visible. Your repair cost is $3000.00. There is nothing you can do now but shell out.

5) The dollar index suddenly dropped 1% overnight! You cannot believe it?! Believe it or not the dollars you were ill advised to buy are worth 2% less. Why? It is not because the sky is so high but because the euro jumped on positive zonal economic news reported in the German media. Pay up your loss of $1000!

6) Your last transaction was termed illegal insider trading. Does not matter you do not even know what that is. Somebody broke some rules on your name. Your fine is $1500.

7) While you were cruising around your partners (players) duped you for $500.00 each by 'adjusting' the account books. You found out? A little too late it would appear. You have no choice but to pay up—pay each player $500.

8) You thought you had it in your pocket! Your adviser told you that since frost was predicted in Florida the frozen concentrated orange juice futures have no place to go but higher. Well, they are down big time. For one, the frost was light and not enough to cause significant damage. Second, in today's agricultural report, the estimated production was raised by 3 million boxes, which was higher than estimated. Or did your adviser not tell you the report was due today, before the markets were due to open, while you and possibly he were in bed! And that the markets are often very volatile on this day. They are today and your loss is $1500.

9) Nobody's fault if you did not ask when the stock options you bought last week were due to expire. Now you know. They expired today! Worthless! And you still owe the premium of $1000. Pay up!

10) You should not have blindly trusted that Wall Street 'suit' you met 2 days ago. The junk bonds you bought via him are worthless. The loss of $2000 is all yours! You have no choice but to pay up.

11) You were told the yen will keep appreciating against the dollar, since the Japanese economy is improving, were you? Did your broker also tell you that the Japanese have been vocally unhappy at the rapid rise probably because it makes Japanese exports costly and less competitive? You got talked into buying yen. Too bad because yesterday the Japanese depreciated the yen by selling their own currency. Your loss is $1500.

12) You are told you miscalculated the broker's commission; or did you??? Anyway the statement seems to indicate you owe the Exchange $1000. You know the rules, pay first and ask questions later. And realistically just pay and drop it; go to court and the lawyers will charge more.

13) False tip?! The new stock did not open off the roof as you were told was sure to happen! The only sure thing on Wall Street is that the sun rises in the east and sets in the west. You just lost $2000 payable to the Exchange now!

14) You got yourself into buying bonds just before short term interest rates were raised! And today bond prices have dropped sharply? What's that? You were told the chance of a rate rise was zero? Are you sure they did not say nearly zero? What is certain now is that add 200 to the left of that zero and that is the dollar amount of your loss. Surely, even you can do that. Yes, that is correct. Your loss is $2000.

15) You buy oil sector shares and the petroleum exporters raise production overnight? And your broker says this is unprecedented, he had no idea such a thing would happen, etc., etc.? Actually it was rather expected. Petroleum exporters have been talking about this publicly for some time. Either your broker is ignorant or downright untruthful. Or he just cared about your commission. As expected oil stocks have dropped sharply and your loss is $2000. Pay up.

16) Did you not know the law of physics—what goes up always comes down? You bought real estate in that northwest suburb where land prices have kept going up? And they will, your adviser told you? Too bad for you the Mayor just announced further northward city expansion will not occur and prices are down big time. Your loss is $1500.

17) You are long corn futures?? Because you heard there is a drought in the offing? For your information two huge storm systems are going to pass though the Corn Belt and corn prices are down sharply. So much for weather predictions. Might as well look into a crystal ball. Your loss of $2000 is due now!

18) Did you know that the Chief Executive Officer (CEO) of that software giant was dumping his company stock for the last 2 months? Obviously not, because you just bought the stock due to bad advice. For all you now you may have bought it from that CEO!! And today the company filed for chapter 11 bankruptcy protection. Your loss is $2000.

19) You bought that chipmaker stock because you were told it was about to spilt? And that prices would double. Let me tell you my dear friend, what I think. A stock spilt does nothing to enhance corporate earnings, the principle driving force behind stock prices. Merely increases the number of potential stockholders. Therefore, in spite of the split the stock is down sharply. That is because soon after the split, the company announced an earnings shortfall. Your loss is $1500.

20) You allowed your adviser talk you into selling an unleaded gasoline put option? You could not have been more foolhardy! Did you not know selling an option is fraught with unlimited risk? What did she tell you?? The-summer driving season is round the corner and unleaded prices will keep increasing. That is generally true but if the economy is in trouble and production is high, such as now, supply could exceed demand and prices can fall. That is exactly what is going on and prices of gasoline are down. At least your know-all adviser called and asked you to get out and take a loss. Your loss is $2000 but could have been much higher.

21) Your broker had you buy a Stock Index futures contract and went to sleep. While both you and your adviser were asleep, major political crisis developed in Asia. As a result, this morning, even before the market opened, stock futures are down sharply. Your loss from this one transaction is $1500. Got to pay up!

22) Don't keep all your eggs in one basket. Did you not hear that? Seems not because you did, rather most of your money in that software giant. Today there is a rumor of major accounting problems and stock is down. You have to get out and take a loss of $3000.

23) You know nothing about the metals market yet you allowed yourself into being long a palladium futures contract. Because, you are told, prices will continue to go up due to supply problems. While you were sleeping huge supplies were evident from a major Asian exporter. And the market is opening down. You have to get out and take a loss of $2000.

24) You bought oat futures because a recent study showed daily oat-based cereal decreases the risk of heart attacks. And you were told that this news, along with some weather problems in growing areas, would result in higher prices. Fact is December oats futures are up 300% in the last 2 months—an all time record move. What your adviser did not tell you it is short-term overbought and sitting at major technical resistance levels. This morning oats have opened down and likely to spiral down further due to profit taking. Your loss is $1500.

25) Technology boom, technology boom, technology boom! So you kept buying technology stocks because you are told the sky is the price limit. What you were not told is that most of your holdings are trading at values greater than 300 times their earnings per share ratios and are severely overvalued. Today markets are down sharply because of a single earnings warning from the Silicon Valley. Technology stocks could fall by up to 75% over the next few months once the market comes to grips with the valuations. Get out! You have to take a loss of $2000 before you lose it all!

26) You were at the wrong seat at the Stock Exchange and that too after the market opened! Does not matter that you were misdirected and today is your first day. Pay up a fine of $500.

27) You were lead to believe soy oil prices will keep rising because soybeans are trending up. You get yourself positioned long July soy oil. Were you also told there is a tendency for soy oil to track Malaysian palm oil futures, which are down sharply while you were sleeping, and your adviser was warming her bed with the help of your commissions? Today bean oil is down big time and pay up your loss of $1500.

28) You blindly bought a whole life insurance policy 2 months ago. And today you read about the potential advantage of a term life policy, for your situation. Cut your losses and get out of this policy. Your loss will be two month's premium amounting to $2000.

Still further, as noted above, the game apparatus may also include a plurality of game cards corresponding to the "YOU STRUCK GOLD!" positions or spaces on the game board. On one face of the cards may be marked the legend "YOU STRUCK GOLD!" (optionally with a unique number) and on the other face of the cards may be described a fictitious and imaginary scenario and an action to be taken by the player. Further, each of the game cards may include a reference to explanations of financial concepts provided on a separate sheet. The text associated with a number of illustrative examples of the "YOU STRUCK GOLD!" cards follow, each representing a fictitious and imaginary scenario.

1) The new stock you got into at the ground level skyrocketed on the first day. Do you have a crystal ball? Collect your profit of $1000.

2) Your investment in British Pound futures gave you a 100% profit in one day! Overnight British consumer sentiment was reported to be much higher than expected suggesting the British economy will continue on the track of expansion. Can I have your broker's number? Go collect $2000.

3) Good for you, you positioned yourself long cocoa futures. The price of cocoa has shot up due to a variety of problems in Ivory Coast. You can cash in your profit of $1500.

4) You must thank your neighbor for talking you into buying that piece of land just outside the city. The city has decided to expand and the land has appreciated by 5% overnight. Cash in your profit of $500.

5) Your no-load mutual fund has performed exceptionally well and the Exchange has $1000 waiting for you.

6) Your honest stockbroker (there is such a thing!) has refunded overpaid commissions of $500. Go collect.

7) Your gardener found an old silver coin of the time of the Civil War buried in your back yard when he was digging to plant your new trees. It seems it is worth $3000. Go collect.

8) You should be glad you bought natural gas company stocks. The meteorologists have just predicted a Midwest heat wave for the next month. The price of natural gas and your stock is up. Go collect your gain of $1000.

9) Be glad you listened to your broker and bought into the oil sector. Petroleum exporters just announced a surprise oil production cut. Oil stocks are up sharply. You profit is $1500, waiting at the Exchange.

10) No expected interest rate cut! Your advisor was right on the money! That too going against the market. Bond future prices are up sharply and your long position is looking great. Collect your gain of $1500.

11) Your cousin seems to know what he is doing—working for that that accounting giant whose stock he talked you into buying, when it was down, saying the new leadership is dynamic. They just won a major contract and stock gained 20% in a day! Collect $1000.

12) Energy prices are up after a cold winter. And the price of the oil company stock you own is up. Cash in a profit $500.

13) Yesterday, a huge draw in gasoline inventories was reported—much greater than the market expected for this time of the year. Your long unleaded gasoline futures position has become quite profitable. You made $2000.

14) A huge tobacco lawsuit is thrown out and the price of your tobacco company holding has jumped. Your profit, $1000, is waiting to be collected.

15) That unheard of biotech you bought into seems to have made a breakthrough in cancer research. The drug regulators just approved their novel cancer-treating drug. Their stock has skyrocketed. Cash in your gain of $2000.

16) A patent infringement suit against your software company is dismissed! Are you not glad you bought its' stock?! Up 25% today. Collect your profit of $500.

17) Your company just won patent rights for its new metal processing method. Good for you, you own a part of it! Stock is up 20% today. Collect your profit of $500.

18) What in the heavens made you buy that aircraft manufacturing giant stock? It has been at multi-year lows for months. So what if your broker suggested it. Will you jump into the well if she so suggests?? Earlier today, news came out on the wires that they are awarded a huge defense contract! Stock is up sharply, as expected. Cash in $2000.

19) What kind of hunch did you have? Buying that software company stock call options at throwaway premium prices 1 week before expiry! Today a huge take-over is announced, just a day before options expiry. Stock is up sharply and your options' value has quadrupled in a day. Cash in $3000.

20) What made you buy November soybeans? Because it seemed too hot where you live in the Midwest? Today the several leading private weather forecasters are calling for a summer drought. Soybean prices are going towards the moon! You profited $2000.

21) Can I have the phone number of your real-estate broker? Property prices in the north of the city, where you let him talk you into buying some land, have jumped overnight due to plans of a huge new supermarket. Go cash in your profit of $2000.

22) What in heavens made you short on September Stock Index Futures? Because it began to rain in the Sahara? Good call because today markets are down sharply due to rumors of a major war in Europe, in the east. Go collect your profit of $2000.

23) Lucky you—short seller of airlines' stock. You did that based on what, the phase of the moon?? Whatever it may be, a flight crash on the east coast has caused a massive sell off in airlines stock today. Go cash in your $1000 profit.

24) Did you dream about Brazil and open a new long position in coffee futures? Did you not know that coffee stocks are at record levels for months, and demand is slow? Well, there was a major frost in the Brazilian coffee growing regions and coffee futures are up sharply. Go pocket $1200.

25) Your timing of buying gold was golden! Overnight, a major strike was declared in a leading mining company, expected to last for weeks, may be longer, and gold prices are up. Go cash in $1000.

26) What made you execute a long July/short December lean hog futures spread? Did you not know that according to the previous agricultural report the number of hogs available for slaughter by end of the year was up by only 1% year over year. This increase would be easily absorbed by demand, and still leave a deficit, and as a result the price of December contract was likely to go up. Seems you got a great tip or great advice or some sign from the stars because today's report shows less front-end supply but a 2% upward revision in the year-end supply. As a result the July contract, which has a marked discount to cash, is up today and the December futures are down. Your profit is $2000.

27) Do you have intercontinental vision? Is that why you are long March wheat? It appears you do because you seem to have telescopically seen the major weather problems being faced by the Australian wheat. As a result wheat futures are up and you profit $1500. Go collect.

Still further, as noted above, the game apparatus may also include a plurality of game cards corresponding to the "END OF QUARTER I" position or space on the game board. On one face of the cards may be marked the legend "END OF QUARTER I" (optionally with a unique number) and on the other face of the cards may be described a fictitious and imaginary scenario and an action to be taken by the player. Further, each of the game cards may include a reference to explanations of financial concepts provided on a separate sheet. The text associated with a number of illustrative examples of the "END OF QUARTER I" cards follow, each representing a fictitious and imaginary scenario.

1) A major player in one the sectors you prominently own raises earnings and revenue forecast (projects earnings per share a penny above the consensus estimate) for the coming quarter. The sector stocks are up and the value of your portfolio is up by 5% overnight. Collect $1000.

2) A major player in one of the sectors you prominently own issues an earning warning and lowers revenue projections (projects earnings a penny below the consensus estimate) for the next quarter. The sector stocks are down and the value of your portfolio is down by 5% overnight. Pay up $1000.

3) One of the leading companies in the software sector, in which you are heavily invested, beats earnings forecast. Earnings per share reported are a penny greater than the whispered number (final figures 2 pennies above consensus estimate). The entire sector is up and you profit $2000. Go collect.

4) One of the leading companies in the automobile sector, in which you are heavily invested, misses earnings forecast by a penny. Earnings per share reported are a penny less than the whispered number (final figures 2 pennies below consensus estimate). The entire sector is down and your portfolio is down by $2000. Pay this to the Exchange.

Still yet further, as noted above, the game apparatus may also include a plurality of game cards corresponding to the "END OF QUARTER II" position or space on the game board. On one face of the cards may be marked the legend "END OF QUARTER II" (optionally with a unique number) and on the other face of the cards may be described a fictitious and imaginary scenario and an action to be taken by the player. Further, each of the game cards may include a reference to explanations of financial concepts provided on a separate sheet. The text associated with a number of illustrative examples of the "END OF QUARTER II" cards follow, each representing a fictitious and imaginary scenario.

1) A major player in one the sectors you prominently own raises earnings and revenue forecast (projects earnings per share 2 pennies above the consensus estimate) for the coming quarter. The sector stocks are up and the value of your portfolio is up by 10% overnight. Collect $1500.

2) A major player in one the sectors you prominently own issues a earning warning and lowers revenue projections (projects earnings 2 pennies below the consensus estimate) for the next quarter. The sector stocks are down and the value of your portfolio is down by 10% overnight. Pay up $1500.

3) One of the leading companies in the software sector, in which you are heavily invested, beats earnings forecast. Earnings per share reported are 2 pennies greater than the whispered number (final figures 3 pennies above the consensus estimate). The entire sector is up and you profit $1500. Go collect.

4) One of the leading companies in the textile sector, in which you are heavily invested, misses earnings forecast. Earnings per share reported are 2 pennies less than the whispered number (final figures 3 pennies below the consensus estimate). The entire sector is down and your portfolio is down by $2000. Pay this to the Exchange.

Additionally, as noted above, the game apparatus may also include a plurality of game cards corresponding to the "END OF QUARTER III" position or space on the game board. On one face of the cards may be marked the legend "END OF QUARTER III" (optionally with a unique number) and on the other face of the cards may describe a fictitious and imaginary scenario and an action to be taken by the player. Further, each of the game cards may include a reference to explanations of financial concepts provided on a separate sheet. The text associated with a number of illustrative examples of the "END OF QUARTER III" cards follow, each representing a fictitious and imaginary scenario.

1) A major player in one the sectors you prominently own raises earnings and revenue forecast (projects earnings per share 3 pennies above the consensus estimate) for the coming quarter. The sector stocks are up and the value of your portfolio is up by 15% overnight. Collect $2000.

2) A major player in one of the sectors you prominently own issues an earning warning and lowers revenue projections (projects earnings 3 pennies below the consensus estimate) for the next quarter. The sector stocks are down and the value of your portfolio is down by 15% overnight. Pay up $2000.

3) One of the leading companies in the software sector in which you are heavily invested beats earnings forecast. Earnings per share reported are 3 pennies greater than the whispered number (final figures 4 pennies above consensus estimate). The entire sector is up and you profit $2000. Go collect.

4) One of the leading companies in the financial sector, in which you are heavily invested, misses earnings forecast. Earnings per share reported are 3 pennies less than the whispered number (final figures 4 pennies below consensus estimate). The entire sector is down and your portfolio is down by $2000. Pay this to the Exchange.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of playing a stock trading simulation game, comprising:

providing a game apparatus including a game board having a plurality of spaces marked on the game board, the plurality of spaces defining a path of movement on the game board, a portion of the plurality of spaces representing individual stock positions;

establishing an Exchange for handling exchange of game money and stock positions during play of the game;

taking a turn by one of the players, the turn comprising taking a hidden turn and taking an open turn, the hidden turn comprising determining a number of spaces to move a hidden turn game piece along the plurality of spaces, moving the hidden turn game piece the determined number of spaces, and taking any actions indicated on the space on which the hidden turn game piece lands; and the open turn comprising determining a number of spaces to move an open turn game piece along the plurality of spaces, moving the open turn game piece the determined number of spaces and taking any actions indicated on the space on which the open turn game piece lands; and exchanging game money with the Exchange according to instructions marked on a card selected as a result of taking an action indicated on the spaces on which either of the game pieces has landed.

2. The method of claim 1 wherein each said turn by each of the players must include a hidden turn and an open turn.

3. The method of claim 2 wherein taking the open turn additionally comprises buying, if the open turn game piece of the player lands on one of the stock positions that is not and never was owned by any one of the players and no hidden bids are pending for the stock position, the stock position on which the open game piece landed for a predetermined price.

4. The method of claim 1 wherein the plurality of spaces on the game board includes a "START OF THE YEAR/END OF THE YEAR" space, and wherein taking the turn by the player includes receiving a predetermined amount of game money by the player if a game piece of the player lands on the "START OF THE YEAR/END OF THE YEAR" space.

5. The method of claim 1 additionally comprising selecting a method for ending play of the game, from a plurality of methods for ending play of the game, prior to a start of the play of the game.

6. The method of claim 2 wherein taking the open turn additionally comprises buying, if the open turn game piece of the player lands on one of the stock positions that is or was owned by one of the players and no hidden bids are pending for the stock position, the stock position on which the open game piece landed for an adjusted last closing price.

7. The method of claim 6 wherein the adjusted last closing price comprises:

if the roll of the dice for the open turn of the player was even, the adjusted last closing price is a last closing price for the stock position decreased by a predetermined amount; and if the roll of the dice for the open turn of the player was odd, the adjusted last closing price being a last closing price for the stock position increased by a predetermined amount.

8. A method of playing a stock trading simulation game, comprising:

providing a game apparatus including a game board having a plurality of spaces marked on the game board, the plurality of spaces defining a path of movement on the game board, a portion of the plurality of spaces representing individual stock positions;

establishing an Exchange for handling exchange of game money and stock positions during play of the game;

taking a turn by one of the players, the turn comprising taking a hidden turn and taking an open turn;

wherein taking the open turn by one of the players comprises: rolling dice to determine a number of spaces to advance an open turn game piece of the player;

advancing the open turn game piece the number of spaces indicated by the rolled dice; and taking any actions indicated on the space on which the open turn game piece lands;

wherein taking the open turn additionally comprises engaging in bidding for the stock position on which the open turn game piece of the player lands, if the stock position has at least one hidden bid is pending and is not owned by the player whose open turn game piece landed on the stock position space, and determining a winning bid.

9. The method of claim 8 additionally comprising transferring ownership of the stock position to a player winning the bidding upon payment of an amount of game money corresponding to the winning bid by the winning player to a player who owned the stock position before the bidding, or to the Exchange if the position was held by the Exchange.

10. The method of claim 8 wherein if a player's open turn game piece lands on a position for which the same player has an active hidden bid, a hidden bid being active until such time that a trade occurs for the stock position after the hidden bid is entered, the open bid is deemed to be the player's correct bid, as if the hidden bid were non-existent.

11. The method of claim 8 wherein bidding for the stock position includes assessing any wrong bid penalties on any players losing the bidding for the stock position, and paying the wrong bid penalties by the players losing the bidding to the player winning the bidding.

12. The method of claim 11 wherein the wrong bid penalty is assessed according to a method of determining the wrong bid penalty selected prior to beginning play of the game.

13. The method of claim 11 wherein the wrong bid penalty is calculated by setting the wrong bid penalty equal to the absolute value of a difference between the bid of the player and the bid of the winning player.

14. The method of claim 11 wherein the wrong bid penalty is calculated by setting the wrong bid penalty equal to the absolute value of the bid difference of the bid of the player, wherein the bid difference for each of the open and hidden bids comprises:

if the bid was hidden, the bid difference being the absolute value of a difference between the hidden bid of the player and a stock opening price, wherein the stock opening price comprises the open bid of the player who took the open turn; and if the bid was open, the bid difference being the absolute value of a difference between the open bid and the closing price of the stock position, the closing price being the last price of the position or a pre-determined Exchange closing price.

15. The method of claim 14 wherein the closing price is the last trade price of the position.

16. The method of claim 14 wherein the closing price is a predetermined Exchange closing price.

17. The method of claim 14 wherein the open bid is determined to be equal to a predetermined multiple of a roll of the dice.

18. The method of claim 8 wherein bidding for the stock position includes:

entering an open bid for the stock position; and comparing the open bid for the stock position to any hidden bids pending for the stock position, including calculating a bid difference for the open bid and any hidden bids for the stock position.

19. The method of claim 18 wherein the winning bid is determined by establishing which player submitted a bid with the smallest bid difference, the bid with the smallest bid difference being determined to be the winning bid.

20. The method of claim 18 wherein the open bid is determined to be equal to a predetermined multiple of the roll of the dice.

21. The method of claim 18 wherein the bid difference for each of the open and hidden bids comprises:

if the bid was hidden, the bid difference being the absolute value of a difference between the hidden bid of the player and a stock opening price, wherein the stock opening price comprises the open bid of the player taking the open turn; and if the bid was open, the bid difference being the absolute value of a difference between the open bid and a closing price of the stock position, which is the last price of the position or a predetermined Exchange closing price.

22. The method of claim 21 wherein the closing price is the last trade price of the position.

23. The method of claim 21 wherein the closing price is a predetermined Exchange closing price.

24. The method of claim 21 wherein the open bid is determined to be equal to a predetermined multiple of a roll of the dice.

25. A method of playing a stock trading simulation game, comprising:

providing a game apparatus including a game board having a plurality of spaces marked on the game board, the plurality of spaces defining a path of movement on the game board, a portion of the plurality of spaces representing individual stock positions;

establishing an Exchange for handling exchange of game money and stock positions during play of the game;

taking a turn by one of the players, the turn comprising taking a hidden turn and taking an open turn;

wherein taking the open turn by one of the players comprises: rolling dice to determine a number of spaces to advance an open turn game piece of the player;

advancing the open turn game piece the number of spaces indicated by the rolled dice; and taking any actions indicated on the space on which the open turn game piece lands;

wherein taking the open turn additionally comprises paying by the Exchange, if the open turn game piece of the player lands on or passes a space on the game board having "START OF THE YEAR/END OF THE YEAR" marked thereon, a dividend to the player for each of the stock positions owned by the player according to a dividend amount associated with the stock position.

26. The method of claim 25 wherein, if the open turn game piece lands directly on the space having "START OF THE YEAR/END OF THE YEAR" marked thereon, paying by the Exchange a predetermined amount of game money, simultaneously, over and above applicable dividends.

27. A method of playing a stock trading simulation game, comprising:

providing a game apparatus including a game board having a plurality of spaces marked on the game board, the plurality of spaces defining a path of movement on the game board, a portion of the plurality of spaces representing individual stock positions;

establishing an Exchange for handling exchange of game money and stock positions during play of the game;

taking a turn by one of the players, the turn comprising taking a hidden turn and taking an open turn, the hidden turn comprising determining a number of spaces to move a hidden turn game piece along the plurality of spaces, moving the hidden turn game piece the determined number of spaces, and taking any actions indicated on the space on which the hidden turn game piece lands; and the open turn comprising determining a number of spaces to move an open turn game piece along the plurality of spaces, moving the open turn game piece the determined number of spaces and taking any actions indicated on the space on which the open turn game piece lands;

wherein the hidden turn of one of the players comprises:

rolling dice to determine a number of spaces to advance a hidden turn game piece of the player;

advancing the hidden turn game piece the number of spaces indicated by the rolled dice; and recording, if the hidden turn game piece of the player lands on one of the stock position spaces which is not owned by the player whose hidden turn game piece landed on the stock position space, a hidden bid by the player for the stock position space on which the hidden turn game piece has landed.

28. The method of claim 27 wherein taking the hidden turn additionally comprises paying by the Exchange, if the hidden turn game piece lands directly on the space having "START OF THE YEAR/END OF THE YEAR" marked thereon, a predetermined amount of game money.

29. The method of claim 27 wherein bidding is compulsory except if a player's hidden game piece lands on a position for a second occasion, prior to a trade of the stock position after the first occasion.

30. The method of claim 27 wherein if a player's hidden turn game piece lands on a position for a second occasion, prior to a trade of the stock position after the first occasion, the player has the option to replace the old hidden bid and enter a new hidden bid.

31. The method of claim 27 wherein if a player's hidden turn game piece lands on a position on a second occasion, prior to a trade of the stock position after the first occasion. the player has the option to let the old hidden bid stand, and not necessitating the player to enter a new hidden bid.

32. A method of playing a stock trading simulation game, comprising:

providing a game apparatus including a game board having a plurality of spaces marked on the game board, the plurality of spaces defining a path of movement on the game board, a portion of the plurality of spaces representing individual stock positions;

establishing an Exchange for handling exchange of game money and stock positions during play of the game;

taking a turn by one of the players, the turn comprising taking a hidden turn and taking an open turn, the hidden turn comprising determining a number of spaces to move a hidden turn game piece along the plurality of spaces, moving the hidden turn game piece the determined number of spaces, and taking any actions indicated on the space on which the hidden turn game piece lands; and the open turn comprising determining a number of spaces to move an open turn game piece along the plurality of spaces, moving the open turn game piece the determined number of spaces and taking any actions indicated on the space on which the open turn game piece lands; and exchanging game money with the Exchange according to instructions marked on a card selected as a result of taking an action indicated on the spaces on which either of the game pieces has landed;

wherein a method for ending play of the game includes: ending the game if at least one of the players has zero liquidity, a player having zero liquidity when the player has a zero or a negative cash balance, calculating a net asset value for each player; and winning the game by the player having the highest net asset value.

33. A method of playing a stock trading simulation game, comprising:

providing a game apparatus including a game board having a plurality of spaces marked on the game board, the plurality of spaces defining a path of movement on the game board, a portion of the plurality of spaces representing individual stock positions;

establishing an Exchange for handling exchange of game money and stock positions during play of the game;

taking a turn by one of the players, the turn comprising taking a hidden turn and taking an open turn, the hidden turn comprising determining a number of spaces to move a hidden turn game piece along the plurality of spaces, moving the hidden turn game piece the determined number of spaces, and taking any actions indicated on the space on which the hidden turn game piece lands; and the open turn comprising determining a number of spaces to move an open turn game piece along the plurality of spaces, moving the open turn game piece the determined number of spaces and taking any actions indicated on the space on which the open turn game piece lands;

exchanging game money with the Exchange according to instructions marked on a card selected as a result of taking an action indicated on the spaces on which either of the game pieces has landed;

wherein a method for ending play of the game includes:

determining if any of the players has zero liquidity, a player having zero liquidity when the player has a zero or a negative cash balance, and if one of the players has zero liquidity, having the player with zero liquidity sell to the Exchange as many stock positions owned by the player as necessary to regain positive liquidity;

if at least one of the players have zero liquidity and no stock positions to sell, which implies the player is bankrupt, calculating a net asset value for each player; and winning the game by the player having the highest net asset value.

34. The method of claim 33 including providing one of the players with Chapter Battle of Wits bankruptcy protection during bidding, that provides the player with a Chapter Battle of Wits bankruptcy protection loan, comprising:

loaning the player an amount of game money from the Exchange equal to a difference between the winning bid and an amount of game money that the player has on hand after receipt of wrong bid penalties; and if the game continues requiring the player to pay back the amount of game money loaned by the Exchange when the player has an asset value equal to or greater than the amount of game money loaned to the player plus a predetermined amount, and if necessary requiring the player to sell one or more positions to the exchange to make the payback.

35. The method of claim 34 wherein one of the players qualifies for the Chapter Battle of Wits bankruptcy protection loan if:

the player has entered the winning bid for one of the stock positions during bidding for the stock position;

the player has received, from the players that entered losing bids, any wrong bid penalties to which the player is entitled; and the player does not have sufficient game money to pay an amount of the winning bid to an owner of the stock position and the player is unable to raise the required cash by selling any positions to the Exchange.

36. A method of playing a stock trading simulation game, comprising:

providing a game apparatus including a game board having a plurality of spaces marked on the game board, the plurality of spaces defining a path of movement on the game board, a portion of the plurality of spaces representing individual stock positions;

establishing an Exchange for handling exchange of game money and stock positions during play of the game;

taking a turn by one of the players, the turn comprising taking a hidden turn and taking an open turn, the hidden turn comprising determining a number of spaces to move a hidden turn game piece along the plurality of spaces, moving the hidden turn game piece the determined number of spaces, and taking any actions indicated on the space on which the hidden turn game piece lands; and the open turn comprising determining a number of spaces to move an open turn game piece along the plurality of spaces, moving the open turn game piece the determined number of spaces and taking any actions indicated on the space on which the open turn game piece lands; and exchanging game money with the Exchange according to instructions marked on a card selected as a result of taking an action indicated on the spaces on which either of the game pieces has landed;

wherein a method for ending play of the game includes:

setting a time period over which to play the game;

ending the game when the time period has passed or all or all but one of the players have zero liquidity, a player having zero liquidity when the player has a zero or a negative cash balance;

calculating a net asset value for each player; and winning the game by the player having the highest net asset value.

37. The method of claim 36 wherein any players having zero liquidity, a player having zero liquidity when the player has a zero or a negative cash balance, prior to all or all but one of the players having zero liquidity or the end of the game based on the predetermined time, become sleeping players, a sleeping player being one who retains ownership of his or her stock positions and remains able to win the game but cannot actively participate by taking any turns, and whose assets are frozen such that no bidding or trading can occur for stock positions owned by this player.

38. A method of playing a stock trading simulation game, comprising:

providing a game apparatus including a game board having a plurality of spaces marked on the game board, the plurality of spaces defining a path of movement on the game board, a portion of the plurality of spaces representing individual stock positions;

establishing an Exchange for handling exchange of game money and stock positions during play of the game;

taking a turn by one of the players, the turn comprising taking a hidden turn and taking an open turn, the hidden turn comprising determining a number of spaces to move a hidden turn game piece along the plurality of spaces, moving the hidden turn game piece the determined number of spaces, and taking any actions indicated on the space on which the hidden turn game piece lands; and the open turn comprising determining a number of spaces to move an open turn game piece along the plurality of spaces, moving the open turn game piece the determined number of spaces and taking any actions indicated on the space on which the open turn game piece lands;

wherein providing a game apparatus includes:

one of the plurality of spaces having "START OF THE YEAR/END OF THE YEAR" marked thereon;

one of the plurality of spaces having "YOU GOT SCAMMED!" marked thereon;

one of the plurality of spaces having "YOU STRUCK GOLD!" marked thereon;

one of the plurality of spaces having "END OF QUARTER I" marked thereon;

one of the plurality of spaces having "END OF QUARTER II" marked thereon; and one of the plurality of spaces having "END OF QUARTER III" marked thereon.

39. The method of claim 38 including picking, if one of the game pieces of the player lands on one of the spaces having an associated game card, such as the "YOU GOT SCAMMED", "YOU STRUCK GOLD", "END OF QUARTER I", "END OF QUARTER II", and "END OF QUAR- TER III" spaces, one of the associated game cards and following instructions marked on the game card picked by the player.

40. A game apparatus for playing a stock trading simulation game by a plurality of players, the game apparatus comprising:

a game board having a plurality of spaces marked on the game board, the plurality of spaces defining a path of movement on the game board;

a quantity of game money for providing each player with an amount of the game money;

a trade transaction sheet for recording trades of stock positions and an amount of game money associated with the trade;

hidden bid cards for secretly recording hidden bids of each player for the stock positions;

a number of game pieces for marking the position of a player on the spaces of the game board, the game pieces including an open turn game piece and a hidden turn game piece for each player, the open turn and hidden turn game pieces of each player having the same color, the game pieces of different players having different colors; and a plurality of game cards, each of the game cards having numerical indicia marked thereon;

wherein at least two of the plurality of spaces has different indicia marked thereon;

wherein at least two of the plurality of game cards has different indicia marked thereon, the indicia on a first one of the at least two game cards matches a first one of the different indicia on a first one of the plurality of spaces and a second one of the at least two game cards matches a second one of the different indicia on a second one of the plurality of spaces;

wherein:

a portion of the plurality of spaces representing individual stock positions, each of the stock position spaces having a number marked thereon;

one of the plurality of spaces having "START OF THE YEAR/END OF THE YEAR" indicia marked thereon;

one of the plurality of spaces having "YOU GOT SCAMMED!" indicia marked thereon;

one of the plurality of spaces having "YOU STRUCK GOLD!" indicia marked thereon;

one of the plurality of spaces having "END OF QUARTER I" indicia marked thereon;

one of the plurality of spaces having "END OF QUARTER II" indicia marked thereon; and one of the plurality of spaces having "END OF QUARTER III" indicia marked thereon.

41. The game apparatus of claim 40 wherein a first portion of the plurality of game cards each correspond to one of the stock positions of the spaces on the path of the game board such that possession of the game card indicates ownership of the corresponding stock position, each of the game cards of the first portion having a dividend amount marked thereon.

42. The game apparatus of claim 40 wherein:

a second portion of the plurality of cards each corresponds to the plurality of spaces having "YOU GOT SCAMMED!" indicia marked thereon;

a third portion of the plurality of cards each corresponding to the plurality of spaces having "YOU STRUCK GOLD!" indicia marked thereon;

a fourth portion of the plurality of cards each corresponding to the space having "END OF QUARTER I" indicia marked thereon;

a fifth portion of the plurality of cards each corresponding to the space having "END OF QUARTER II" indicia marked thereon; and a sixth portion of the plurality of cards each corresponding to the space having "END OF QUARTER III" indicia marked thereon.

43. A method of playing a stock trading simulation game, comprising:

providing a game apparatus comprising:

a game board having a plurality of spaces marked on a top surface of the game board, the plurality of spaces defining an endless path of movement on the game board, a portion of the plurality of spaces representing individual stock positions, each of the stock position spaces having a number marked thereon;

one of the plurality of spaces having "START OF THE YEAR/END OF THE YEAR" marked thereon;

one of the plurality of spaces having "YOU GOT SCAMMED!" marked thereon;

one of the plurality of spaces having "YOU STRUCK GOLD!" marked thereon;

one of the plurality of spaces having "END OF QUARTER I" marked thereon;

one of the plurality of spaces having "END OF QUARTER II" marked thereon;

one of the plurality of spaces having "END OF QUARTER III" marked thereon;

a trade transaction sheet for recording trades of stock positions and an amount of game money associated with the trade;

hidden bid cards for secretly recording hidden bids for the stock positions;

a quantity of game money, each player having an amount of the game money, the amount of the game money possessed by each player comprising $12,000 in game money, the amount of game money comprising five $1,000 bills, eight $500 bills, and thirty $100 bills;

a number of game pieces for marking the position of a player on the spaces of the game board, the game pieces including an open turn game piece and a hidden turn game piece for each player, the open turn and hidden turn game pieces of each player having the same color, the game pieces of different players having different colors;

a pair of dice;

a plurality of game cards, each of the game cards having numerical indicia marked thereon, a first portion of the plurality of cards each corresponding to one of the stock positions spaces on the path of the game board such that possession of the game card indicates ownership of the corresponding stock position, each of the game cards of the first portion having a dividend amount marked thereon, each of the game cards of the first portion having an imaginary and fictitious identity of a company marked thereon, the first portion comprising 28 cards;

a second portion of the plurality of cards each corresponding to the plurality of spaces having "YOU GOT SCAMMED!" marked thereon, the second portion comprising 28 cards;

a third portion of the plurality of cards each corresponding to the plurality of spaces having "YOU STRUCK GOLD!" marked thereon, the third portion comprising 27 cards;

a fourth portion of the plurality of cards each corresponding to the space having "END OF QUARTER I" marked thereon, the fourth portion comprising four cards;

a fifth portion of the plurality of cards each corresponding to the space having "END OF QUARTER II" marked thereon, the fifth portion comprising four cards;

a sixth portion of the plurality of cards each corresponding to the space having "END OF QUARTER III" marked thereon, the sixth portion comprising four cards;

a plurality of possible methods for ending play of the game, the methods for ending play including:

a first method for ending play comprising:

determining if any of the players has zero liquidity and, a player having zero liquidity when the player has a zero or a negative cash balance, if at least one player has zero liquidity calculating a net asset value for each player; and winning the game by the player having the highest net asset value;

a second method for ending play comprising:

determining if any of the players has zero liquidity, a player having zero liquidity when the player has a zero or a negative cash balance, and if one of the players has zero liquidity, having the player with zero liquidity become a sleeping player, a sleeping player being one who retains ownership of his or her stock positions and remains able to win the game but cannot actively participate by taking any turns, and whose assets are frozen such that no bidding or trading can occur for stock positions owned by this player and if all or all but one of the players have zero liquidity , calculating a net asset value for each player; and winning the game by the player having the highest net asset value;

a third method for ending play comprising:

determining if any of the players is bankrupt, a player becoming bankrupt when the player has a zero or a negative cash balance and has no positions to sell if at least one player is bankrupt, calculating a net asset value for each player; and winning the game by the player having the highest net asset value;

a fourth method for ending play comprising:

determining if any of the players is bankrupt, a player becoming bankrupt when the player has a zero or a negative cash balance and has no positions to sell if all or all but one of the players are bankrupt, calculating a net asset value for each player; and winning the game by the player having the highest net asset value;

a fifth method for ending play comprising:

setting a time period over which to play the game;

ending the game when the time period has passed or all or all but one of the players have zero liquidity, a player having zero liquidity when the player has a zero or a negative cash balance calculating a net asset value for each player; and winning the game by the player having the highest net asset value;

a sixth method of ending play comprising:

setting a time period over which to play the game;

ending the game when the time period has passed or all or all but one of the players are bankrupt, a player becoming bankrupt when the player has a zero or a negative cash balance and has no positions to sell;

calculating a net asset value for each player; and winning the game by the player having the highest net asset value;

establishing an Exchange for handling exchange of game money and stock positions during play of the game, which owns all the stock positions at the start of the game;

choosing a player to move first during play of the game;

taking a turn by one of the players, the turn comprising taking a hidden turn and taking an open turn;

wherein the hidden turn comprises:

rolling the dice to determine a number of spaces to advance the hidden turn game piece of the player;

advancing the hidden turn game piece the number of spaces indicated by the rolled dice;

recording, if the hidden turn game piece of the player lands on one of the stock position spaces, a hidden bid on the player's hidden bid card for the stock position space on which the hidden turn game piece has landed;

wherein the open turn comprises:

rolling the dice to determine a number of spaces to advance the open turn game piece of the player;

advancing the open turn game piece the number of spaces indicated by the rolled dice;

paying by the Exchange, if the open turn game piece of the player lands on or passes the space having "START OF THE YEAR/END OF THE YEAR" marked thereon, a dividend to the player for each of the stock positions owned by the player according to the dividend amount marked on the game cards corresponding to the stock positions owned by the player;

buying, if the open turn game piece of the player lands on one of the stock positions that is not or never has been owned by one of the players and no hidden bids are pending for the stock position, the stock position on which the open game piece landed for a predetermined Exchange closing price, wherein the predetermined Exchange closing price comprises $1000;

buying, if the open turn game piece of the player lands on one of the stock positions and no hidden bids are pending for the stock position, the stock position on which the open game piece landed for an adjusted last closing price, the adjusted last closing price comprising:

if the roll of the dice for the open turn was even, the adjusted last closing price being a last closing price for the stock position decreased by a predetermined amount;

if the roll of the dice for the open turn was odd, the adjusted last closing price being a last closing price for the stock position increased by a predetermined amount;

engaging in bidding for the stock position on which the open turn game piece of the player lands if the stock position has at least one hidden bid is pending, including:

entering an open bid for the stock position, an amount of the open bid being equal to a predetermined multiple of a roll of the dice;

comparing the open bid for the position to any hidden bids pending for the stock position, including calculating a bid difference for the open bid and any hidden bids for the stock position;

wherein the bid difference comprises:

if the bid was hidden, the bid difference being the absolute value of a difference between the hidden bid of the player and a stock opening price, wherein the stock opening price comprises the open bid of the player whose open turn game piece landed on the stock position space;

if the bid was open, the bid difference being the absolute value of a difference between the open bid and a closing price of the stock position, wherein the closing price comprises the last price for the stock position or a pre-determined Exchange closing price, the latter applicable for the price of positions which have never previously traded;

determining a winning player in the bidding by establishing which bid of the players has the smallest bid difference;

assessing any wrong bid penalties on any players losing the bidding for the stock position, wherein the wrong bid penalty is assessed according to one of the following methods:

a first method comprising setting the wrong bid penalty equal to the absolute value of a difference between the bid of the player and the bid of the winning player;

a second method comprising setting the wrong bid penalty equal to the absolute value of the bid difference of the bid of the player;

transferring ownership of the stock position to the winning player upon payment by the winning bidder to a player who owned the stock position before the bidding or to the Exchange, in case the position is held by the Exchange;

receiving a predetermined amount of game money by the player if one of the game pieces of the player lands on the space having "START OF THE YEAR/END OF THE YEAR" marked thereon, over and above applicable dividends, which are receivable by the player simultaneously;

picking, if one of the game pieces of the player lands on one of the spaces having an associated game card, such as the "YOU GOT SCAMMED", "YOU STRUCK GOLD", "END OF QUARTER I", "END OF QUARTER II", and "END OF QUARTER III" spaces, one of the associated game cards and following instructions marked on the game card picked by the player;

providing one of the players with Chapter Battle of Wits bankruptcy protection during bidding, that provides the player with a Chapter Battle of Wits bankruptcy protection loan, if:

the game is played using the third, fourth or sixth method of ending play;

the player has entered the winning bid for one of the stock positions during bidding for the stock position;

the player has received any wrong bid penalties to which the winning player is entitled from the players that entered losing bids;

the player does not have sufficient game money, even after sale of the player's position or positions to the Exchange, to pay an amount of the winning bid to an owner of the stock position, which may be another player or the Exchange, which was the object of the bidding;

giving the player an amount of game money from the Exchange equal to a difference between the winning bid and game money that the player has on hand; and if the game continues requiring the player to pay back the amount of game money loaned by the Exchange when the player has an asset value equal to or greater than the amount of game money loaned to the player plus a predetermined amount, and if necessary in order to make the payback requiring the player to sell one or more positions to the Exchange.

44. The method of claim 43 wherein bidding is compulsory if a hidden or open turn game piece of a player lands on a stock position space on the game board, except if the stock position is owned by the same player or except if a player's hidden game piece lands on a position on a second occasion, prior to a trade of the stock position after the first occasion.

45. The method of claim 43 wherein if a player's open turn game piece lands on a position for which the same player has an active hidden bid, a hidden bid being active until such time that a trade occurs for the stock position after the hidden bid is entered, the open bid is deemed to be the player's correct bid, as if the hidden bid were non-existent.

46. The method of claim 43 wherein if a player's hidden turn game piece lands on a position for a second occasion, prior to a trade of the stock position after the first occasion, the player has the option to replace the old hidden bid and enter a new hidden bid.

47. The method of claim 43 wherein if a player's hidden turn game piece lands on a position on a second occasion, prior to a trade of the stock position after the first occasion, the player has the option to let the old hidden bid stand, and not necessitating the player to enter a new hidden bid.

48. A method of playing a stock trading simulation game, comprising:

providing a game apparatus including a game board having a plurality of spaces marked on the game board, the plurality of spaces defining a path of movement on the game board, a portion of the plurality of spaces representing individual stock positions;

establishing an Exchange for handling exchange of game money and stock positions during play of the game;

taking a turn by one of the players, the turn comprising taking a hidden turn and taking an open turn, the hidden turn comprising determining a number of spaces to move a hidden turn game piece along the plurality of spaces, moving the hidden turn game piece the determined number of spaces, and taking any actions indicated on the space on which the hidden turn game piece lands; and the open turn comprising determining a number of spaces to move an open turn game piece along the plurality of spaces, moving the open turn game piece the determined number of spaces and taking any actions indicated on the space on which the open turn game piece lands;

wherein a method for ending play of the game includes:

determining if any of the players has zero liquidity, a player having zero liquidity when the player has a zero or a negative cash balance; and if all or all but one of the players have zero liquidity calculating a net asset value for each player; and winning the game by the player having the highest net asset value.

49. The method of claim 48 wherein any players having zero liquidity, a player having zero liquidity when the player has a zero or a negative cash balance, prior to all or all but one of the players having zero liquidity, become sleeping players, a sleeping player being one who retains ownership of his or her stock positions and remains able to win the game but cannot actively participate by taking any turns, and whose assets are frozen such that no bidding or trading can occur for stock positions owned by this player.

50. A method of playing a stock trading simulation game, comprising:

providing a game apparatus including a game board having a plurality of spaces marked on the game board, the plurality of spaces defining a path of movement on the game board, a portion of the plurality of spaces representing individual stock positions;

establishing an Exchange for handling exchange of game money and stock positions during play of the game;

taking a turn by one of the players, the turn comprising taking a hidden turn and taking an open turn, the hidden turn comprising determining a number of spaces to move a hidden turn game piece along the plurality of spaces, moving the hidden turn game piece the determined number of spaces, and taking any actions indicated on the space on which the hidden turn game piece lands; and the open turn comprising determining a number of spaces to move an open turn game piece along the plurality of spaces, moving the open turn game piece the determined number of spaces and taking any actions indicated on the space on which the open turn game piece lands; and exchanging game money with the Exchange according to instructions marked on a card selected as a result of taking an action indicated on the spaces on which either of the game pieces has landed;

wherein a method for ending play of the game includes:

determining if any of the players has zero liquidity, a player having zero liquidity when the player has a zero or a negative cash balance, and if one or more of the players have zero liquidity, having the player with zero liquidity sell to the Exchange as many stock positions owned by the player as necessary to regain positive liquidity;

if all or all but one of the players have zero liquidity and no stock positions to sell, which implies bankruptcy, calculating a net asset value for each player; and winning the game by the player having the highest net asset value.

51. The method of claim 50 including providing one of the players with Chapter Battle of Wits bankruptcy protection during bidding, that provides the player with a Chapter Battle of Wits bankruptcy protection loan, comprising:

loaning the player an amount of game money from the Exchange equal to a difference between the winning bid and an amount of game money that the player has on hand; and if the game continues requiring the player to pay back the amount of game money loaned by the Exchange when the player has an asset value equal to or greater than the amount of game money loaned to the player plus a predetermined amount, and if necessary requiring the player to sell one or more positions to the exchange to make the payback.

52. The method of claim 51 wherein one of the players qualifies for the Chapter Battle of Wits bankruptcy protection loan if:

the player has entered the winning bid for one of the stock positions during bidding for the stock position;

the player has received, from the players that entered losing bids, any wrong bid penalties to which the player is entitled; and the player does not have sufficient game money to pay an amount of the winning bid to an owner of the stock position and the player is unable to raise the required cash by selling any positions to the Exchange.

53. A method of playing a stock trading simulation game, comprising:

providing a game apparatus including a game board having a plurality of spaces marked on the game board, the plurality of spaces defining a path of movement on the game board, a portion of the plurality of spaces representing individual stock positions;

establishing an Exchange for handling exchange of game money and stock positions during play of the game;

taking a turn by one of the players, the turn comprising taking a hidden turn and taking an open turn, the hidden turn comprising determining a number of spaces to move a hidden turn game piece along the plurality of spaces, moving the hidden turn game piece the determined number of spaces, and taking any actions indicated on the space on which the hidden turn game piece lands; and the open turn comprising determining a number of spaces to move an open turn game piece along the plurality of spaces, moving the open turn game piece the determined number of spaces and taking any actions indicated on the space on which the open turn game piece lands; and exchanging game money with the Exchange according to instructions marked on a card selected as a result of taking an action indicated on the spaces on which either of the game pieces has landed;

wherein a method for ending play of the game includes:

setting a time period over which to play the game;

ending the game when the time period has passed or all or all of the players but one is bankrupt, a player becoming bankrupt when the player has a zero or a negative cash balance and has no positions to sell;

calculating a net asset value for each player; and winning the game by the player having the highest net asset value.

54. The method of claim 53 including providing one of the players with Chapter Battle of Wits bankruptcy protection during bidding, that provides the player with a Chapter Battle of Wits bankruptcy protection loan, comprising:

loaning the player an amount of game money from the Exchange equal to a difference between the winning bid and an amount of game money that the player has on hand; and if the game continues requiring the player to pay back the amount of game money loaned by the Exchange when the player has an asset value equal to or greater than the amount of game money loaned to the player plus a predetermined amount, and if necessary requiring the player to sell one or more positions to the exchange to make the payback.

55. The method of claim 54 wherein one of the players qualifies for the Chapter Battle of Wits bankruptcy protection loan if:

the player has entered the winning bid for one of the stock positions during bidding for the stock position;

the player has received, from the players that entered losing bids, any wrong bid penalties to which the player is entitled; and the player does not have sufficient game money to pay an amount of the winning bid to an owner of the stock position; and the player is unable to raise the required cash by selling any positions to the Exchange.

* * * * *